US009353426B2

(12) United States Patent
Tanaka et al.

(10) Patent No.: US 9,353,426 B2
(45) Date of Patent: May 31, 2016

(54) SILVER-WHITE COPPER ALLOY AND METHOD OF PRODUCING SILVER-WHITE COPPER ALLOY

(71) Applicants: Mitsubishi Shindoh Co., Ltd., Tokyo (JP); Mitsubishi Materials Corporation, Tokyo (JP)

(72) Inventors: Shinji Tanaka, Osaka (JP); Keiichiro Oishi, Osaka (JP); Hiroharu Ogawa, Saitama (JP)

(73) Assignees: MITSUBISHI MATERIALS CORPORATION, Tokyo (JP); MITSUBISHI SHINDOH CO., LTD., Tokyo (JP)

( * ) Notice: Subject to any disclaimer, the term of this patent is extended or adjusted under 35 U.S.C. 154(b) by 0 days.

(21) Appl. No.: 14/069,086

(22) Filed: Oct. 31, 2013

(65) Prior Publication Data

US 2014/0124106 A1 May 8, 2014

Related U.S. Application Data

(63) Continuation of application No. PCT/JP2012/066356, filed on Jun. 27, 2012.

(30) Foreign Application Priority Data

Jun. 29, 2011 (JP) ..... P2011-143883

(51) Int. Cl.
*C22F 1/08* (2006.01)
*C22C 9/04* (2006.01)

(52) U.S. Cl.
CPC .... *C22C 9/04* (2013.01); *C22F 1/08* (2013.01)

(58) Field of Classification Search
CPC ..... C22F 1/08
USPC ..... 148/679; 420/479
See application file for complete search history.

(56) References Cited

U.S. PATENT DOCUMENTS

| | | | | |
|---|---|---|---|---|
| 2,101,626 | A * | 12/1937 | Munson | 420/479 |
| 4,147,568 | A | 4/1979 | Marechal | |
| 5,885,376 | A | 3/1999 | Suzuki et al. | |
| 2006/0065336 | A1 | 3/2006 | Gillieron et al. | |

FOREIGN PATENT DOCUMENTS

| | | | |
|---|---|---|---|
| CN | 101952469 | A | 1/2011 |
| JP | 02-274828 | A | 11/1990 |

(Continued)

OTHER PUBLICATIONS

JIS Handbook, Non-Ferrous Metals & Metallurgy, Japanese Standards Association, JIS H 3110, Phosphor bronze and nickel silver sheets, plates and strips, pp. 757-768, 2008.

(Continued)

*Primary Examiner* — Jie Yang
(74) *Attorney, Agent, or Firm* — Griffin and Szipl PC

(57) ABSTRACT

Provided are a silver-white copper alloy which has superior mechanical properties such as hot workability, cold workability, or press property, color fastness, bactericidal and antibacterial properties, and Ni allergy resistance; and a method of producing such a silver-white copper alloy. The silver-white copper alloy includes 51.0 mass % to 58.0 mass % of Cu; 9.0 mass % to 12.5 mass % of Ni; 0.0003 mass % to 0.010 mass % of C; 0.0005 mass % to 0.030 mass % of Pb; and the balance of Zn and inevitable impurities, in which a relationship of $65.5 \leq [Cu]+1.2\times[Ni] \leq 70.0$ is satisfied between a content of Cu [Cu] (mass %) and a content of Ni [Ni] (mass %). In a metal structure thereof, an area ratio of β phases dispersed in an α-phase matrix is 0% to 0.9%.

13 Claims, 13 Drawing Sheets

(56) References Cited

FOREIGN PATENT DOCUMENTS

| | | | |
|---|---|---|---|
| JP | 07-292427 | A | 11/1995 |
| JP | 09-087793 | A | 3/1997 |
| JP | 11-001735 | A | 1/1999 |
| JP | 2002-294369 | A | 10/2002 |
| JP | 2005-325413 | A | 11/2005 |
| JP | 2006-520850 | A | 9/2006 |

OTHER PUBLICATIONS

JIS Handbook, Non-Ferrous Metals & Metallurgy, Japanese Standards Association, JIS H 3100, Copper and copper alloy sheets, plates and strips, pp. 707-756, 2008.

JIS Handbook, Non-Ferrous Metals & Metallurgy, Japanese Standards Association, JIS H 3100, Phosphor bronze and nickel silver sheets, plates and strips, pp. 757-768, 2008.

International Search Report issued in corresponding application PCT/JP2012/066356, completed Aug. 2, 2012 and mailed Sep. 18, 2012.

Office Action issued in corresponding Taiwanese application 101123485 on Aug. 30, 2013.

Office Action issued in co-pending related U.S. Appl. No. 14/115,062 on Jun. 26, 2014.

Copper and copper alloy fundamentals and engineering, 1994, pp. 260, 261.

* cited by examiner

FIG. 1

| | ALLOY NO. | ALLOY COMPOSITION (mass%) | | | | | | | | | | | Zn/Cu RATIO | COMPOSITION INDEX f1 |
|---|---|---|---|---|---|---|---|---|---|---|---|---|---|---|
| | | Cu | Zn | Ni | Pb | C | Mn | Al | P | Sb | Mg | As | | |
| FIRST ALLOY ACCORDING TO PRESENT INVENTION | 1 | 53.5 | 35.9 | 10.6 | 0.005 | 0.0012 | | | | | | | 0.67 | 66.2 |
| | 2 | 54.1 | 35.1 | 10.8 | 0.0006 | 0.0004 | | | | | | | 0.65 | 67.1 |
| | 3 | 54.5 | 34.4 | 11.1 | 0.010 | 0.0017 | | | | | | | 0.63 | 67.8 |
| | 4 | 51.7 | 36.2 | 12.1 | 0.014 | 0.0004 | | | | | | | 0.70 | 66.2 |
| | 5 | 55.8 | 33.4 | 10.8 | 0.006 | 0.0015 | | | | | | | 0.60 | 68.8 |
| | 6 | 56.2 | 33.5 | 10.3 | 0.005 | 0.0025 | | | | | | | 0.60 | 68.6 |
| | 7 | 57.1 | 32.7 | 10.2 | 0.008 | 0.0026 | | | | | | | 0.57 | 69.3 |
| | 8 | 51.1 | 36.5 | 12.4 | 0.028 | 0.0091 | | | | | | | 0.71 | 66.0 |
| | 9 | 57.8 | 32.9 | 9.3 | 0.0013 | 0.0006 | | | | | | | 0.57 | 69.0 |
| | 10 | 53.0 | 36.5 | 10.5 | 0.012 | 0.0031 | | | | | | | 0.69 | 65.6 |
| | 11 | 52.8 | 35.7 | 11.5 | 0.002 | 0.0018 | | | | | | | 0.68 | 66.6 |
| | 12 | 54.6 | 34.7 | 10.7 | 0.0011 | 0.007 | | | | | | | 0.64 | 67.4 |
| SECOND ALLOY ACCORDING TO PRESENT INVENTION | 13 | 51.1 | 36.3 | 11.8 | 0.018 | 0.0051 | 0.8 | | | | | | 0.71 | 65.6 |
| | 14 | 51.3 | 36.1 | 12.1 | 0.008 | 0.0017 | 0.5 | | | | | | 0.70 | 66.0 |
| | 15 | 51.9 | 34.6 | 12.0 | 0.011 | 0.0005 | 1.5 | | | | | | 0.67 | 66.9 |
| | 16 | 53.1 | 35.7 | 10.7 | 0.005 | 0.0018 | 0.5 | | | | | | 0.67 | 66.1 |
| | 17 | 53.4 | 35.4 | 10.8 | 0.008 | 0.0025 | 0.4 | | | | | | 0.66 | 66.5 |
| | 18 | 53.4 | 35.1 | 10.9 | 0.005 | 0.0075 | 0.6 | | | | | | 0.66 | 66.7 |
| | 19 | 53.6 | 35.5 | 10.7 | 0.009 | 0.0030 | 0.2 | | | | | | 0.66 | 66.5 |
| | 20 | 54.0 | 35.0 | 10.4 | 0.012 | 0.0021 | 0.6 | | | | | | 0.65 | 66.7 |
| | 21 | 54.0 | 34.6 | 10.9 | 0.028 | 0.0012 | 0.5 | | | | | | 0.64 | 67.3 |
| | 22 | 54.1 | 34.0 | 11.4 | 0.006 | 0.0031 | 0.5 | | | | | | 0.63 | 68.0 |
| | 23 | 54.1 | 33.7 | 11.6 | 0.008 | 0.0095 | 0.6 | | | | | | 0.62 | 68.3 |
| | 24 | 54.1 | 33.1 | 12.2 | 0.006 | 0.0018 | 0.6 | | | | | | 0.61 | 69.0 |
| | 25 | 54.5 | 33.5 | 11.4 | 0.007 | 0.0015 | 0.6 | | | | | | 0.61 | 68.4 |
| | 26 | 55.4 | 34.6 | 9.5 | 0.004 | 0.0009 | 0.5 | | | | | | 0.62 | 67.0 |
| | 27 | 55.6 | 33.3 | 10.6 | 0.008 | 0.0010 | 0.5 | | | | | | 0.60 | 68.5 |
| | 28 | 56.3 | 32.9 | 10.3 | 0.009 | 0.0016 | 0.5 | | | | | | 0.58 | 68.9 |
| | 29 | 56.9 | 31.4 | 9.9 | 0.001 | 0.0032 | 1.8 | | | | | | 0.55 | 69.5 |
| | 30 | 57.5 | 31.9 | 10.0 | 0.002 | 0.0017 | 0.6 | | | | | | 0.55 | 69.7 |
| | 31 | 54.3 | 34.6 | 10.6 | 0.004 | 0.0009 | 0.5 | | | | | | 0.64 | 67.2 |
| | 32 | 52.8 | 35.2 | 11.4 | 0.003 | 0.0007 | 0.6 | | | | | | 0.67 | 66.7 |
| THIRD ALLOY ACCORDING TO PRESENT INVENTION | 33 | 52.9 | 35.1 | 11.4 | 0.012 | 0.0035 | 0.5 | 0.12 | | | | | 0.66 | 66.8 |
| | 34 | 54.2 | 34.0 | 11.2 | 0.009 | 0.0013 | 0.5 | 0.09 | | | | | 0.63 | 67.8 |
| | 35 | 55.5 | 33.0 | 10.8 | 0.008 | 0.0031 | 0.6 | | 0.06 | | | | 0.60 | 68.7 |
| | 36 | 53.5 | 35.1 | 10.9 | 0.01 | 0.0061 | 0.5 | | | 0.03 | | | 0.66 | 66.8 |
| | 37 | 54.2 | 34.0 | 11.3 | 0.01 | 0.0011 | 0.5 | | | | 0.012 | | 0.63 | 68.0 |
| | 38 | 52.4 | 36.0 | 11.0 | 0.007 | 0.0029 | 0.6 | | | | | 0.03 | 0.69 | 65.8 |
| | 39 | 54.1 | 34.4 | 10.8 | 0.01 | 0.0016 | 0.5 | 0.15 | | 0.03 | 0.01 | | 0.64 | 67.3 |
| | 40 | 54.3 | 34.5 | 10.2 | 0.008 | 0.002 | 0.9 | 0.11 | 0.03 | | | | 0.63 | 66.9 |
| | 41 | 54.0 | 34.7 | 10.5 | 0.009 | 0.0015 | 0.6 | 0.10 | 0.04 | | | | 0.64 | 66.8 |

FIG. 2

| | | ALLOY COMPOSITION (mass%) | | | | | | | | | | | Zn/Cu RATIO | COMPOSITION INDEX f1 |
|---|---|---|---|---|---|---|---|---|---|---|---|---|---|---|
| | | Cu | Zn | Ni | Pb | C | Mn | Al | P | Sb | Mg | As | | |
| FOR COMPARISON | 101 | 50.6 | 37.0 | 12.4 | 0.005 | 0.0016 | | | | | | | 0.73 | 65.5 |
| | 102 | 51.6 | 37.4 | 11 | 0.009 | 0.0010 | | | | | | | 0.72 | 64.8 |
| | 103 | 54.7 | 33.0 | 12.3 | 0.0003 | 0.0001 | | | | | | | 0.60 | 69.5 |
| | 104 | 54.0 | 33.4 | 12.6 | 0.006 | 0.013 | | | | | | | 0.62 | 69.1 |
| | 105 | 54.6 | 36.7 | 8.7 | 0.032 | 0.0021 | | | | | | | 0.67 | 65.0 |
| | 106 | 58.3 | 29.9 | 11.8 | 0.007 | 0.0031 | | | | | | | 0.51 | 72.5 |
| | 107 | 54.8 | 36.4 | 8.8 | 0.006 | 0.0015 | | | | | | | 0.66 | 65.4 |
| | 108 | 55.0 | 32.2 | 12.8 | 0.008 | 0.0072 | | | | | | | 0.59 | 70.4 |
| | 109 | 50.7 | 36.6 | 12.3 | 0.006 | 0.0018 | 0.4 | | | | | | 0.72 | 65.6 |
| | 110 | 51.4 | 37.0 | 11.1 | 0.002 | 0.0015 | 0.5 | | | | | | 0.72 | 64.9 |
| | 111 | 52.0 | 34.7 | 13.0 | 0.003 | 0.0028 | 0.3 | | | | | | 0.67 | 67.7 |
| | 112 | 55.9 | 31.7 | 11.8 | 0.001 | 0.0025 | 0.6 | | | | | | 0.57 | 70.3 |
| | 113 | 53.1 | 35.8 | 10.8 | 0.010 | 0.0002 | 0.3 | | | | | | 0.67 | 66.2 |
| | 114 | 53.7 | 32.7 | 11.0 | 0.004 | 0.0022 | 2.6 | | | | | | 0.61 | 67.9 |
| | 115 | 53.8 | 34.9 | 10.9 | 0.005 | 0.012 | 0.4 | | | | | | 0.65 | 67.0 |
| | 116 | 54.0 | 35.0 | 11.0 | 0.008 | 0.0021 | 0.03 | | | | | | 0.65 | 67.2 |
| | 117 | 54.1 | 34.3 | 11.1 | 0.035 | 0.0007 | 0.5 | | | | | | 0.63 | 67.6 |
| | 118 | 55.0 | 33.4 | 11.1 | 0.0002 | 0.0023 | 0.5 | | | | | | 0.61 | 68.5 |
| | 119 | 56.9 | 34.1 | 8.5 | 0.002 | 0.0012 | 0.5 | | | | | | 0.60 | 67.3 |
| | 120 | 58.6 | 30.2 | 10.7 | 0.005 | 0.0019 | 0.5 | | | | | | 0.52 | 71.6 |
| | 121 | 54.0 | 34.1 | 11 | 0.005 | 0.0018 | 0.6 | 0.32 | | | | | 0.63 | 67.4 |
| | 122 | 53.5 | 34.3 | 11.3 | 0.003 | 0.0024 | 0.8 | | 0.12 | | | | 0.64 | 67.4 |
| | 123 | 54.2 | 34.8 | 10.8 | 0.004 | 0.0027 | | | | 0.11 | | 0.13 | 0.64 | 67.2 |
| | 124 | 53.8 | 35.5 | 10.7 | 0.005 | 0.0034 | | | | | 0.04 | | 0.66 | 66.6 |
| C7060 | | 88.4 | <0.001 | 9.6 | | | 0.7 | Fe: 1.3mass% | | | | | | 100.2 |
| C7521 | | 64.1 | 19.0 | 16.75 | 0.001 | | 0.2 | | | | | | | 84.3 |
| C2680 | | 64.9 | 35.1 | | | | | | | | | | | - |

FIG. 4

| | ALLOY NO. | PRODUCTION PROCESS | TEST NO. | 20% COLD-ROLLED MATERIAL | | HOT ROLLING | HEAT TREATMENT | | | | HOT WORKABILITY | COLD WORKABILITY | TENSILE TEST (AFTER HEAT TREATMENT) | | | TENSILE TEST (20% COLD-ROLLED MATERIAL) | | |
|---|---|---|---|---|---|---|---|---|---|---|---|---|---|---|---|---|---|---|
| | | | | AREA RATIO (%) OF β PHASES | GRAIN SIZE (μm) | COOLING RATE IN 400°C TO 500°C (°C/sec) | MAXIMUM ACHIEVED TEMPERATURE Tmax (°C) | RETENTION TIMETH (min) | HEAT TREATMENT INDEX It | COOLING RATE IN 400°C TO 500°C (°C/sec) | | | STRENGTH (N/mm²) | ELONGATION (%) | TENSILE INDEX f2 | STRENGTH (N/mm²) | ELONGATION (%) | TENSILE INDEX f2 |
| FIRST ALLOY ACCORDING TO PRESENT INVENTION EX. | 1 | P1 | A-1 | 0.3 | 6 | 2.5 | 705 | 0.3 | 541 | 2.5 | A | A | 471 | 38 | 650 | 587 | 18 | 693 |
| | 2 | | A-2 | 0.0 | 5 | 2.5 | 705 | 0.3 | 541 | 2.5 | A | A | 476 | 45 | 690 | 595 | 21 | 720 |
| | 3 | | A-3 | 0.0 | 5 | 2.5 | 705 | 0.3 | 541 | 2.5 | A | A | 484 | 49 | 721 | 594 | 22 | 725 |
| | 4 | | A-4 | 0.6 | 9 | 2.5 | 705 | 0.3 | 541 | 2.5 | A | B | 471 | 40 | 659 | 580 | 14 | 661 |
| | 5 | | A-5 | 0.0 | 8 | 2.5 | 705 | 0.3 | 541 | 2.5 | A | A | 475 | 47 | 698 | 589 | 21 | 713 |
| | 6 | | A-6 | 0.0 | 12 | 2.5 | 705 | 0.3 | 541 | 2.5 | A | A | 469 | 42 | 666 | 584 | 20 | 701 |
| | 7 | | A-7 | 0.0 | 14 | 2.5 | 705 | 0.3 | 541 | 2.5 | B | A | 464 | 40 | 650 | 575 | 18 | 679 |
| | 8 | | A-8 | 0.9 | 7 | 2.5 | 705 | 0.3 | 541 | 2.5 | B | B | 485 | 35 | 655 | 587 | 11 | 652 |
| | 9 | | A-9 | 0.0 | 17 | 2.5 | 705 | 0.3 | 541 | 2.5 | B | A | 460 | 43 | 658 | 579 | 17 | 677 |
| | 10 | | A-10 | 0.6 | 12 | 2.5 | 705 | 0.3 | 541 | 2.5 | B | B | 483 | 36 | 657 | 586 | 12 | 656 |
| | 11 | | A-11 | 0.8 | 9 | 2.5 | 705 | 0.3 | 541 | 2.5 | B | B | 480 | 37 | 658 | 591 | 11 | 656 |
| FIRST ALLOY ACCORDING TO PRESENT INVENTION COMP. EX. | 101 | | A-101 | – | – | 2.5 | – | – | – | – | A | C | – | – | – | – | – | – |
| | 102 | | A-102 | – | – | 2.5 | – | – | – | – | A | C | – | – | – | – | – | – |
| | 103 | | A-103 | 0.2 | 8 | 2.5 | 705 | 0.3 | 541 | 2.5 | B | B | 490 | 37 | 671 | 597 | 17 | 698 |
| | 104 | | A-104 | – | – | 2.5 | – | – | – | – | B | C | – | – | – | – | – | – |
| | 105 | | A-105 | – | – | – | – | – | – | – | C | – | – | – | – | – | – | – |
| | 106 | | A-106 | 0.0 | 9 | 2.5 | 705 | 0.3 | 541 | 2.5 | B | B | 448 | 43 | 641 | 560 | 15 | 644 |
| | 107 | | A-107 | 0.0 | 21 | 2.5 | 705 | 0.3 | 541 | 2.5 | A | A | 430 | 45 | 624 | 535 | 20 | 642 |
| | 108 | | A-108 | 0.2 | 10 | 2.5 | 705 | 0.3 | 541 | 2.5 | A | A | 451 | 41 | 636 | 562 | 14 | 641 |
| SECOND ALLOY ACCORDING TO PRESENT INVENTION EX. | 13 | | A-13 | 0.8 | 8 | 2.5 | 705 | 0.3 | 541 | 2.5 | A | B | 482 | 39 | 670 | 595 | 14 | 678 |
| | 14 | | A-14 | 0.7 | 8 | 2.5 | 705 | 0.3 | 541 | 2.5 | A | B | 477 | 37 | 653 | 591 | 15 | 680 |
| | 15 | | A-15 | 0.3 | 7 | 2.5 | 705 | 0.3 | 541 | 2.5 | A | B | 494 | 42 | 701 | 610 | 16 | 708 |
| | 16 | | A-16 | 0.3 | 10 | 2.5 | 705 | 0.3 | 541 | 2.5 | A | A | 489 | 38 | 675 | 602 | 15 | 692 |
| | 17 | | A-17 | 0.0 | 8 | 2.5 | 705 | 0.3 | 541 | 2.5 | A | A | 491 | 45 | 712 | 610 | 23 | 750 |
| | 18 | | A-18 | 0.0 | 7 | 2.5 | 705 | 0.3 | 541 | 2.5 | A | A | 502 | 50 | 753 | 618 | 23 | 760 |
| | 19 | | A-19 | 0.0 | 8 | 2.5 | 705 | 0.3 | 541 | 2.5 | A | A | 501 | 50 | 752 | 620 | 23 | 763 |
| | 20 | | A-20 | 0.0 | 7 | 2.5 | 705 | 0.3 | 541 | 2.5 | A | A | 505 | 47 | 742 | 629 | 23 | 774 |
| | 21 | | A-21 | 0.0 | 8 | 2.5 | 705 | 0.3 | 541 | 2.5 | A | B | 503 | 44 | 724 | 618 | 20 | 742 |
| | 22 | | A-22 | 0.0 | 9 | 2.5 | 705 | 0.3 | 541 | 2.5 | A | A | 500 | 49 | 745 | 618 | 24 | 766 |
| | 23 | | A-23 | 0.0 | 7 | 2.5 | 705 | 0.3 | 541 | 2.5 | B | B | 495 | 47 | 728 | 615 | 21 | 744 |
| | 24 | | A-24 | 0.2 | 8 | 2.5 | 705 | 0.3 | 541 | 2.5 | B | A | 491 | 43 | 702 | 607 | 20 | 728 |
| | 25 | | A-25 | 0.0 | 8 | 2.5 | 705 | 0.3 | 541 | 2.5 | A | B | 500 | 45 | 725 | 616 | 18 | 727 |
| | 26 | | A-26 | 0.0 | 8 | 2.5 | 705 | 0.3 | 541 | 2.5 | A | A | 479 | 42 | 680 | 571 | 17 | 668 |

FIG. 5

| | ALLOY NO. | PRODUCTION PROCESS | TEST NO. | BENDABILITY | WELDABILITY | | PRESS PROPERTY | BACTERICIDAL PROPERTY 1 | BACTERICIDAL PROPERTY 2 | COLOR FASTNESS TEST 1 | COLOR FASTNESS TEST 2 | CORROSION RESISTANCE | Ni ALLERGY RESISTANCE | WELDED PIPE (DRAWING) | | |
|---|---|---|---|---|---|---|---|---|---|---|---|---|---|---|---|---|
| | | | | | FLATTENING TEST | COLD DRAWING | | | | | | | | STRENGTH ($N/mm^2$) | ELONGATION (%) | TENSILE INDEX f2 |
| FIRST ALLOY ACCORDING TO PRESENT INVENTION EX. | 1 | P1 | a-1 | B | | | A | A | A | B | B | A | A | | | |
| | 2 | | a-2 | A | | | B | A | A | A | A | A | A | | | |
| | 3 | | a-3 | A | | | A | A | A | A | A | A | A | | | |
| | 4 | | a-4 | B | | | B | A | A | B | B | A | | | | |
| | 5 | | a-5 | A | | | B | B | A | B | B | A | | | | |
| | 6 | | a-6 | A | | | B | A | B | B | B | A | | | | |
| | 7 | | a-7 | A | | | B | B | B | B | A | A | | | | |
| | 8 | | a-8 | B | | | A | B | B | B | B | A | | | | |
| | 9 | | a-9 | A | | | B | B | B | B | A | A | | | | |
| | 10 | | a-10 | B | | | B | B | B | B | B | A | | | | |
| | 11 | | a-11 | B | | | B | B | B | B | B | A | | | | |
| FIRST ALLOY ACCORDING TO PRESENT INVENTION COMP. EX. | 101 | | a-101 | - | | | - | - | - | - | - | - | | | | |
| | 102 | | a-102 | - | | | - | - | - | - | - | - | | | | |
| | 103 | | a-103 | A | | | C | A | A | A | B | A | | | | |
| | 104 | | a-104 | - | | | - | - | - | - | - | - | | | | |
| | 105 | | a-105 | - | | | - | - | - | - | - | - | | | | |
| | 106 | | a-106 | A | | | C | B | B | B | B | A | | | | |
| | 107 | | a-107 | A | | | C | B | B | B | C | A | | | | |
| | 108 | | a-108 | B | | | B | B | B | C | B | A | | | | |
| SECOND ALLOY ACCORDING TO PRESENT INVENTION EX. | 13 | | a-13 | B | | | A | B | B | B | B | A | | | | |
| | 14 | | a-14 | B | | | A | B | B | B | A | A | | | | |
| | 15 | | a-15 | B | | | A | A | A | B | A | A | | | | |
| | 16 | | a-16 | A | | | B | A | A | A | A | A | | | | |
| | 17 | | a-17 | A | | | A | A | A | A | A | A | A | | | |
| | 18 | | a-18 | A | | | A | A | A | A | A | A | | | | |
| | 19 | | a-19 | A | | | A | A | A | A | A | A | | | | |
| | 20 | | a-20 | A | | | A | A | A | A | A | A | | | | |
| | 21 | | a-21 | B | | | A | A | A | A | A | A | | | | |
| | 22 | | a-22 | A | | | A | A | A | A | A | A | | | | |
| | 23 | | a-23 | B | | | A | A | A | A | B | A | | | | |
| | 24 | | a-24 | B | | | A | A | A | B | A | A | | | | |
| | 25 | | a-25 | B | | | A | A | A | B | B | A | | | | |
| | 26 | | a-26 | A | | | B | A | A | B | B | A | A | | | |

FIG. 6

| | ALLOY NO. | PRODUCTION PROCESS | TEST NO. | 20% COLD-ROLLED MATERIAL | | HOT ROLLING | HEAT TREATMENT | | | | HOT WORKABILITY | COLD WORKABILITY | TENSILE TEST (AFTER HEAT TREATMENT) | | | TENSILE TEST (20% COLD-ROLLED MATERIAL) | | |
|---|---|---|---|---|---|---|---|---|---|---|---|---|---|---|---|---|---|---|
| | | | | AREA RATIO (%) OF β PHASES | GRAIN SIZE (μm) | COOLING RATE IN 400°C TO 500°C (°C/sec) | MAXIMUM ACHIEVED TEMPERATURE Tmax (°C) | RETENTION TIME Th (min) | HEAT TREATMENT INDEX It | COOLING RATE IN 400°C TO 500°C (°C/sec) | | | STRENGTH (N/mm²) | ELONGATION (%) | TENSILE INDEX f2 | STRENGTH (N/mm²) | ELONGATION (%) | TENSILE INDEX f2 |
| SECOND ALLOY ACCORDING TO PRESENT INVENTION EX. | 27 | P1 | a-27 | 0.0 | 10 | 2.5 | 705 | 0.3 | 541 | 2.5 | A | A | 490 | 42 | 696 | 604 | 20 | 725 |
| | 28 | | a-28 | 0.0 | 10 | 2.5 | 705 | 0.3 | 541 | 2.5 | B | A | 465 | 47 | 684 | 587 | 24 | 728 |
| | 29 | | a-29 | 0.0 | 13 | 2.5 | 705 | 0.3 | 541 | 2.5 | A | A | 465 | 45 | 674 | 584 | 17 | 683 |
| | 30 | | a-30 | 0.0 | 13 | 2.5 | 705 | 0.3 | 541 | 2.5 | A | A | 469 | 46 | 685 | 578 | 17 | 676 |
| SECOND ALLOY ACCORDING TO PRESENT INVENTION COMP. EX. | 109 | | a-109 | 1.6 | 6 | 2.5 | 705 | 0.3 | 541 | 2.5 | A | C | 479 | 32 | 632 | 598 | 12 | 670 |
| | 110 | | a-110 | - | - | 2.5 | - | - | - | - | B | C | - | - | - | - | - | - |
| | 111 | | a-111 | - | - | 2.5 | - | - | - | - | B | C | - | - | - | - | - | - |
| | 112 | | a-112 | 0.0 | 8 | 2.5 | 705 | 0.3 | 541 | 2.5 | B | B | 470 | 37 | 644 | 577 | 12 | 646 |
| | 113 | | a-113 | 0.1 | 10 | 2.5 | 705 | 0.3 | 541 | 2.5 | A | A | 494 | 40 | 692 | 604 | 14 | 689 |
| | 114 | | a-114 | - | - | - | - | - | - | - | C | - | - | - | - | - | - | - |
| | 115 | | a-115 | - | - | 2.5 | - | - | - | - | B | C | - | - | - | - | - | - |
| | 116 | | a-116 | 0.0 | 8 | 2.5 | 705 | 0.3 | 541 | 2.5 | A | A | 478 | 43 | 684 | 597 | 19 | 710 |
| | 117 | | a-117 | - | - | - | - | - | - | - | C | - | - | - | - | - | - | - |
| | 118 | | a-118 | 0.0 | 12 | 2.5 | 705 | 0.3 | 541 | 2.5 | A | A | 494 | 48 | 731 | 615 | 20 | 738 |
| | 119 | | a-119 | 0.0 | 15 | 2.5 | 705 | 0.3 | 541 | 2.5 | A | A | 451 | 44 | 649 | 569 | 18 | 671 |
| | 120 | | a-120 | 0.0 | 16 | 2.5 | 705 | 0.3 | 541 | 2.5 | A | A | 451 | 41 | 636 | 563 | 15 | 647 |
| THIRD ALLOY ACCORDING TO PRESENT INVENTION EX. | 33 | | a-33 | 0.2 | 9 | 2.5 | 705 | 0.3 | 541 | 2.5 | A | A | 503 | 43 | 719 | 620 | 17 | 725 |
| | 34 | | a-34 | 0.0 | 9 | 2.5 | 705 | 0.3 | 541 | 2.5 | A | A | 505 | 47 | 742 | 626 | 19 | 745 |
| | 35 | | a-35 | 0.0 | 8 | 2.5 | 705 | 0.3 | 541 | 2.5 | A | A | 488 | 45 | 708 | 580 | 21 | 702 |
| | 36 | | a-36 | 0.0 | 8 | 2.5 | 705 | 0.3 | 541 | 2.5 | A | A | 499 | 48 | 739 | 617 | 25 | 771 |
| | 37 | | a-37 | 0.0 | 8 | 2.5 | 705 | 0.3 | 541 | 2.5 | A | A | 497 | 46 | 726 | 617 | 20 | 740 |
| | 38 | | a-38 | 0.6 | 7 | 2.5 | 705 | 0.3 | 541 | 2.5 | A | B | 485 | 38 | 669 | 602 | 11 | 668 |
| | 39 | | a-39 | 0.0 | 8 | 2.5 | 705 | 0.3 | 541 | 2.5 | A | A | 509 | 45 | 738 | 624 | 18 | 736 |
| | 40 | | a-40 | 0.0 | 12 | 2.5 | 705 | 0.3 | 541 | 2.5 | A | A | 506 | 43 | 724 | 621 | 18 | 733 |
| THIRD ALLOY ACCORDING TO PRESENT INVENTION COMP. EX. | 121 | | a-121 | 0.0 | 8 | 2.5 | 705 | 0.3 | 541 | 2.5 | A | A | 515 | 45 | 747 | 632 | 17 | 739 |
| | 122 | | a-122 | - | - | - | - | - | - | - | C | - | - | - | - | - | - | - |
| | 123 | | a-123 | 0.0 | 9 | 2.5 | 705 | 0.3 | 541 | 2.5 | A | B | 470 | 27 | 597 | 578 | 8.5 | 627 |
| | 124 | | a-124 | - | - | - | - | - | - | - | C | - | - | - | - | - | - | - |
| COMP. EX. | C7060 | | a-1001 | 0.0 | | | 705 | 0.3 | 541 | 2.5 | | A | 310 | 42 | 440 | 415 | 14 | 473 |
| COMP. EX. | C7521 | | a-1002 | 0.0 | | | 705 | 0.3 | 541 | 2.5 | | A | 420 | 35 | 567 | 580 | 5 | 609 |
| COMP. EX. | C2680 | | a-1003 | 0.1 | | | 705 | 0.3 | 541 | 2.5 | | A | 315 | 55 | 488 | 473 | 13 | 534 |

FIG. 7

| | ALLOY NO. | PRODUCTION PROCESS | TEST NO. | BENDABILITY | WELDABILITY | | PRESS PROPERTY | BACTERICIDAL PROPERTY 1 | BACTERICIDAL PROPERTY 2 | COLOR FASTNESS TEST 1 | COLOR FASTNESS TEST 2 | CORROSION RESISTANCE | Ni ALLERGY RESISTANCE | WELDED PIPE (DRAWING) | | |
|---|---|---|---|---|---|---|---|---|---|---|---|---|---|---|---|---|
| | | | | | FLATTENING TEST | COLD DRAWING | | | | | | | | STRENGTH (N/mm$^2$) | ELONGATION (%) | TENSILE INDEX f2 |
| SECOND ALLOY ACCORDING TO PRESENT INVENTION EX. | 27 | P1 | a-27 | A | | | B | A | A | A | A | A | | | | |
| | 28 | | a-28 | A | | | B | A | B | A | B | A | | | | |
| | 29 | | a-29 | A | | | C | A | A | A | B | A | | | | |
| | 30 | | a-30 | A | | | B | A | B | A | A | A | | | | |
| SECOND ALLOY ACCORDING TO PRESENT INVENTION COMP. EX. | 109 | | a-109 | D | | | A | B | B | C | C | C | C | | | |
| | 110 | | a-110 | – | | | – | – | – | – | – | – | | | | |
| | 111 | | a-111 | – | | | – | – | – | – | – | – | | | | |
| | 112 | | a-112 | A | | | C | B | B | B | B | A | | | | |
| | 113 | | a-113 | A | | | C | A | A | A | A | A | | | | |
| | 114 | | a-114 | – | | | – | – | – | – | – | – | | | | |
| | 115 | | a-115 | – | | | – | – | – | – | – | – | | | | |
| | 116 | | a-116 | A | | | A | A | A | A | B | A | | | | |
| | 117 | | a-117 | – | | | – | – | – | – | – | – | | | | |
| | 118 | | a-118 | A | | | C | A | A | A | B | A | | | | |
| | 119 | | a-119 | A | | | B | B | C | B | C | A | | | | |
| | 120 | | a-120 | A | | | C | B | B | A | B | A | | | | |
| THIRD ALLOY ACCORDING TO PRESENT INVENTION Ex. | 33 | | a-33 | A | | | A | A | A | A | A | A | | | | |
| | 34 | | a-34 | A | | | A | A | A | A | A | A | | | | |
| | 35 | | a-35 | A | | | B | A | A | A | A | A | | | | |
| | 36 | | a-36 | A | | | A | A | A | A | A | A | | | | |
| | 37 | | a-37 | A | | | A | A | A | A | A | A | | | | |
| | 38 | | a-38 | A | | | A | A | B | A | A | A | | | | |
| | 39 | | a-39 | A | | | A | A | A | A | A | A | A | | | |
| | 40 | | a-40 | A | | | A | A | A | A | A | A | | | | |
| THIRD ALLOY ACCORDING TO PRESENT INVENTION COMP. EX. | 121 | | a-121 | A | | | A | B | C | A | A | A | | | | |
| | 122 | | a-122 | – | | | – | – | – | – | – | – | | | | |
| | 123 | | a-123 | D | | | A | A | A | A | A | A | | | | |
| | 124 | | a-124 | – | | | – | – | – | – | – | – | | | | |
| COMP. Ex. C7060 | | | a-1001 | A | | | C | B | C | B | B | A | C | | | |
| COMP. EX. C7521 | | | a-1002 | A | | | B | B | B | B | A | A | C | | | |
| COMP. EX. C2680 | | | a-1003 | A | | | C | B | B | A | C | C | – | | | |

FIG. 8

| | ALLOY NO. | PRODUCTION PROCESS | TEST NO. | 20% COLD-ROLLED MATERIAL | | HOT ROLLING | HEAT TREATMENT | | | | HOT WORKABILITY | COLD WORKABILITY | TENSILE TEST (AFTER HEAT TREATMENT) | | | TENSILE TEST (20% COLD-ROLLED MATERIAL) | | |
|---|---|---|---|---|---|---|---|---|---|---|---|---|---|---|---|---|---|---|
| | | | | AREA RATIO (%) OF β PHASES | GRAIN SIZE (μm) | COOLING RATE IN 400°C TO 500°C (°C/sec) | MAXIMUM ACHIEVED TEMPERATURE Tmax (°C) | RETENTION TIME TH (min) | HEAT TREATMENT INDEX It | COOLING RATE IN 400°C TO 500°C (°C/sec) | | | STRENGTH (N/mm²) | ELONGATION (%) | TENSILE INDEX f2 | STRENGTH (N/mm²) | ELONGATION (%) | TENSILE INDEX f2 |
| FIRST ALLOY ACCORDING TO PRESENT INVENTION WELDED PIPE EX. | 12 | P2 | b-1 | 0.0 | 6 | 2.3 | 705 | 0.25 | 525 | 2.3 | A | A | 506 | 47 | 744 | 620 | 21 | 750 |
| | | | b-2 | 0.0 | 12 | 2.3 | 705 | 0.5 | 578 | 2.3 | A | A | 470 | 46 | 686 | 571 | 20 | 685 |
| SECOND ALLOY ACCORDING TO PRESENT INVENTION WELDED PIPE EX. | 31 | | b-3 | 0.0 | 6 | 2.3 | 705 | 0.25 | 525 | 2.3 | A | A | 510 | 44 | 734 | 625 | 24 | 775 |
| | | | b-4 | 0.0 | 9 | 2.3 | 680 | 0.5 | 553 | 2.3 | A | A | 496 | 53 | 759 | 617 | 21 | 747 |
| | 32 | | b-5 | 0.0 | 8 | 2.3 | 705 | 0.25 | 525 | 2.3 | A | A | 515 | 48 | 762 | 630 | 22 | 769 |
| | | | b-6 | 0.1 | 14 | 2.3 | 705 | 0.5 | 578 | 2.3 | A | A | 467 | 45 | 677 | 579 | 23 | 712 |
| THIRD ALLOY ACCORDING TO PRESENT INVENTION WELDED PIPE EX. | 41 | | b-7 | 0.0 | 7 | 2.3 | 705 | 0.25 | 525 | 2.3 | A | A | 530 | 40 | 742 | 646 | 19 | 769 |
| | | | b-8 | 0.0 | 14 | 2.3 | 720 | 0.5 | 593 | 2.3 | A | A | 510 | 45 | 740 | 634 | 20 | 761 |
| FIRST ALLOY ACCORDING TO PRESENT INVENTION WELDED PIPECOMP. EX. | 12 | | b-101 | 1.6 | 10 | 2.3 | 720 | 0.25 | 540 | 0.3 | A | A | 481 | 33 | 640 | 593 | 11 | 658 |
| SECOND ALLOY ACCORDING TO PRESENT INVENTION WELDED PIPE COMP. EX. | 31 | | b-102 | 1.5 | 8 | 2.3 | 730 | 0.25 | 550 | 0.3 | A | A | 489 | 32 | 645 | 605 | 10 | 666 |
| THIRD ALLOY ACCORDING TO PRESENT INVENTION WELDED PIPE COMP. EX. | 41 | | b-103 | 1.4 | 8 | 2.3 | 705 | 0.25 | 525 | 0.3 | A | A | 498 | 30 | 647 | 601 | 6.5 | 640 |

FIG. 9

| | ALLOY NO. | PRODUCTION PROCESS | TEST NO. | BENDABILITY | WELDABILITY | | PRESS PROPERTY | BACTERICIDAL PROPERTY 1 | BACTERICIDAL PROPERTY 2 | COLOR FASTNESS TEST 1 | COLOR FASTNESS TEST 2 | CORROSION RESISTANCE | Ni ALLERGY RESISTANCE | WELDED PIPE (DRAWING) | | | WELDED PIPE (DRAWING) | | |
|---|---|---|---|---|---|---|---|---|---|---|---|---|---|---|---|---|---|---|---|
| | | | | | FLATTENING TEST | COLD DRAWING | | | | | | | | STRENGTH ($N/mm^2$) | ELONGATION (%) | TENSILE INDEX f2 | STRENGTH ($N/mm^2$) | ELONGATION (%) | TENSILE INDEX f2 |
| FIRST ALLOY ACCORDING TO PRESENT INVENTION WELDED PIPE EX. | 12 | P2 | b-1 | A | A | A | A | A | A | A | A | A | | 531 | 41 | 749 | 641 | 16 | 744 |
| | | | b-2 | A | A | A | A | A | A | A | A | A | | 509 | 38 | 702 | 593 | 13 | 670 |
| SECOND ALLOY ACCORDING TO PRESENT INVENTION WELDED PIPE EX. | 31 | | b-3 | A | A | A | A | A | A | A | A | A | | 545 | 36 | 741 | 667 | 15 | 767 |
| | | | b-4 | A | A | A | A | A | A | A | A | A | | 526 | 49 | 784 | 642 | 13 | 725 |
| | 32 | | b-5 | A | A | A | A | A | A | A | A | A | | 549 | 43 | 785 | 671 | 15 | 772 |
| | | | b-6 | A | A | A | A | A | A | A | B | A | | 499 | 40 | 699 | 608 | 14 | 693 |
| THIRD ALLOY ACCORDING TO PRESENT INVENTION WELDED PIPE EX. | 41 | | b-7 | A | A | A | A | A | A | A | A | A | | 566 | 32 | 747 | 678 | 11 | 753 |
| | | | b-8 | A | A | A | A | A | A | A | A | A | | 541 | 40 | 757 | 661 | 13 | 747 |
| FIRST ALLOY ACCORDING TO PRESENT INVENTION WELDED PIPE COMP. EX. | 12 | | b-101 | C | B | B | B | A | A | B | B | C | | 513 | 21 | 621 | 621 | 4 | 646 |
| SECOND ALLOY ACCORDING TO PRESENT INVENTION WELDED PIPE COMP. EX. | 31 | | b-102 | B | C | C | B | A | B | B | B | C | | 515 | 25 | 644 | 601 | 6 | 637 |
| THIRD ALLOY ACCORDING TO PRESENT INVENTION WELDED PIPE COMP. EX. | 41 | | b-103 | C | B | B | B | A | A | B | B | C | | 522 | 16 | 606 | 630 | 2 | 643 |

FIG. 10

| | ALLOY NO. | PRODUCTION PROCESS | TEST NO. | 20% COLD-ROLLED MATERIAL | | HOT ROLLING | HEAT TREATMENT | | | | HOT WORKABILITY | COLD WORKABILITY | TENSILE TEST (AFTER HEAT TREATMENT) | | | TENSILE TEST (20% COLD-ROLLED MATERIAL) | | |
|---|---|---|---|---|---|---|---|---|---|---|---|---|---|---|---|---|---|---|
| | | | | AREA RATIO (%) OF β PHASES | GRAIN SIZE (μm) | COOLING RATE IN 400°C TO 500°C (°C/sec) | MAXIMUM ACHIEVED TEMPERATURE Tmax (°C) | RETENTION TIMETH (min) | HEAT TREATMENT INDEX It | COOLING RATE IN 400°C TO 500°C (°C/SEC) | | | STRENGTH (N/mm²) | ELONGATION (%) | TENSILE INDEX f2 | STRENGTH (N/mm²) | ELONGATION (%) | TENSILE INDEX f2 |
| FIRST ALLOY ACCORDING TO PRESENT INVENTION EX. | 12 | P3 | c-1 | 0.0 | 7 | 2.5 | 705 | 0.3 | 541 | 2.5 | A | A | 481 | 47 | 707 | 589 | 20 | 707 |
| | | | c-2 | 0.0 | 9 | 2.5 | 760 | 0.2 | 559 | 2.5 | A | A | 480 | 46 | 701 | 585 | 21 | 708 |
| | | | c-3 | 0.0 | 16 | 2.5 | 780 | 0.3 | 616 | 2.5 | A | A | 467 | 48 | 691 | 571 | 23 | 702 |
| | | | c-4 | 0.0 | 3 | 2.5 | 515 | 5 | 475 | 2.5 | A | A | 523 | 38 | 722 | 626 | 16 | 726 |
| | | | c-5 | 0.0 | 5 | 2.5 | 530 | 5 | 490 | 2.5 | A | A | 517 | 36 | 703 | 620 | 14 | 707 |
| | | | c-6 | 0.1 | 8 | 1.2 | 705 | 0.3 | 541 | 2.5 | A | A | 479 | 43 | 685 | 581 | 20 | 697 |
| | | | c-7 | 0.6 | 7 | 1.2 | 705 | 0.3 | 541 | 1.2 | A | B | 485 | 36 | 660 | 591 | 14 | 674 |
| SECOND ALLOY ACCORDING TO PRESENT INVENTION EX. | 31 | | c-8 | 0.0 | 8 | 2.5 | 705 | 0.3 | 541 | 2.5 | A | A | 495 | 50 | 743 | 621 | 25 | 776 |
| | | | c-9 | 0.0 | 11 | 2.5 | 760 | 0.2 | 559 | 2.5 | A | A | 482 | 45 | 699 | 601 | 21 | 727 |
| | | | c-10 | 0.0 | 4 | 2.5 | 780 | 0.1 | 495 | 2.5 | A | A | 550 | 34 | 737 | 655 | 13 | 740 |
| | | | c-11 | 0.0 | 15 | 2.5 | 620 | 15 | 597 | 2.5 | A | A | 465 | 48 | 688 | 583 | 21 | 705 |
| | | | c-12 | 0.0 | 9 | 2.5 | 560 | 30 | 544 | 2.5 | A | A | 491 | 49 | 732 | 605 | 22 | 738 |
| | | | c-13 | 0.0 | 7 | 2.5 | 560 | 45 | 547 | 2.5 | A | A | 496 | 51 | 749 | 619 | 24 | 768 |
| | | | c-14 | 0.0 | 21 | 2.5 | 600 | 55 | 588 | 2.5 | A | A | 469 | 45 | 680 | 585 | 20 | 702 |
| | | | c-15 | 0.0 | 8 | 2.5 | 570 | 5 | 530 | 2.5 | A | A | 490 | 51 | 740 | 612 | 23 | 753 |
| | | | c-16 | 0.3 | 8 | 2.5 | 705 | 0.3 | 541 | 1.2 | A | A | 492 | 51 | 743 | 610 | 16 | 708 |
| | | | c-17 | 0.8 | 5 | 1.2 | 705 | 0.3 | 541 | 1.2 | A | B | 488 | 35 | 659 | 605 | 12 | 678 |
| | | | c-18 | 0.0 | 28 | 2.5 | 625 | 85 | 615 | 2.5 | A | A | 438 | 49 | 653 | 552 | 21 | 668 |
| | | | c-19 | 0.1 | 7 | 1.2 | 705 | 0.3 | 541 | 2.5 | A | B | 498 | 49 | 742 | 625 | 21 | 756 |
| | 32 | | c-20 | 0.0 | 9 | 2.5 | 705 | 0.3 | 541 | 2.5 | A | A | 506 | 50 | 759 | 628 | 21 | 760 |
| | | | c-21 | 0.1 | 26 | 2.5 | 760 | 0.3 | 596 | 2.5 | A | A | 452 | 44 | 651 | 571 | 20 | 685 |
| | | | c-22 | 0.0 | 2 | 2.5 | 545 | 1.5 | 472 | 2.5 | A | A | 579 | 17 | 677 | 688 | 4.3 | 718 |
| | | | c-23 | 0.1 | 4 | 2.5 | 560 | 4 | 515 | 2.5 | A | A | 525 | 40 | 735 | 651 | 19 | 775 |
| | | | c-24 | 0.5 | 8 | 2.5 | 705 | 0.3 | 541 | 1.2 | A | A | 500 | 46 | 730 | 624 | 16 | 724 |
| THIRD ALLOY ACCORDING TO PRESENT INVENTION EX. | 41 | | c-25 | 0.0 | 9 | 2.5 | 705 | 0.3 | 541 | 2.5 | A | A | 512 | 41 | 722 | 629 | 19 | 749 |
| | | | c-26 | 0.0 | 5 | 2.5 | 515 | 5 | 475 | 2.5 | A | A | 565 | 34 | 757 | 664 | 15 | 764 |
| | | | c-27 | 0.0 | 10 | 2.5 | 525 | 85 | 515 | 2.5 | A | A | 501 | 47 | 736 | 625 | 21 | 756 |
| | | | c-28 | 0.0 | 6 | 2.5 | 650 | 0.5 | 523 | 2.5 | A | A | 523 | 41 | 737 | 637 | 20 | 764 |
| | | | c-29 | 0.5 | 11 | 2.5 | 750 | 0.2 | 549 | 1.2 | A | A | 524 | 40 | 734 | 640 | 16 | 742 |
| | | | c-30 | 0.8 | 8 | 1.2 | 705 | 0.3 | 541 | 1.2 | A | B | 531 | 35 | 717 | 657 | 14 | 749 |
| | | | c-31 | 0.0 | 25 | 2.5 | 790 | 0.2 | 589 | 2.5 | A | A | 502 | 51 | 758 | 614 | 19 | 731 |

FIG. 11

| | ALLOY NO. | PRODUCTION PROCESS | TEST NO. | BENDABILITY | WELDABILITY | | PRESS PROPERTY | BACTERICIDAL PROPERTY 1 | BACTERICIDAL PROPERTY 2 | COLOR FASTNESS TEST 1 | COLOR FASTNESS TEST 2 | CORROSION RESISTANCE | Ni ALLERGY RESISTANCE | WELDED PIPE (DRAWING) | | |
|---|---|---|---|---|---|---|---|---|---|---|---|---|---|---|---|---|
| | | | | | FLATTENING TEST | GOLD DRAWING | | | | | | | | STRENGTH (N/mm2) | ELONGATION (%) | TENSILE INDEX f2 |
| FIRST ALLOY ACCORDING TO PRESENT NVENTION EX. | 12 | P3 | c-1 | A | | | A | A | A | A | A | A | A | | | |
| | | | c-2 | A | | | A | A | A | A | A | A | | | | |
| | | | c-3 | A | | | B | A | A | A | A | A | | | | |
| | | | c-4 | B | | | A | A | A | A | A | A | | | | |
| | | | c-5 | A | | | A | A | A | A | A | A | | | | |
| | | | c-6 | A | | | A | A | A | A | A | A | | | | |
| | | | c-7 | B | | | A | B | A | B | A | A | | | | |
| SECOND ALLOY ACCORDING TO PRESENT INVENTION EX. | 31 | | c-8 | A | | | A | A | A | A | A | A | A | | | |
| | | | c-9 | A | | | A | A | A | A | A | A | | | | |
| | | | c-10 | B | | | A | A | A | A | A | A | | | | |
| | | | c-11 | A | | | A | A | A | A | A | A | | | | |
| | | | c-12 | A | | | A | A | A | A | A | A | | | | |
| | | | c-13 | A | | | A | A | A | A | A | A | | | | |
| | | | c-14 | A | | | B | A | A | A | A | A | | | | |
| | | | c-15 | A | | | A | A | A | A | A | A | | | | |
| | | | c-16 | A | | | A | A | A | B | A | A | | | | |
| | | | c-17 | B | | | A | B | B | A | B | A | | | | |
| | | | c-18 | B | | | B | A | A | A | B | A | | | | |
| | | | c-19 | A | | | A | A | A | A | A | A | | | | |
| | 32 | | c-20 | A | | | A | A | A | A | A | A | A | | | |
| | | | c-21 | A | | | A | A | A | B | A | A | | | | |
| | | | c-22 | B | | | A | A | A | A | A | A | | | | |
| | | | c-23 | A | | | A | A | A | A | A | A | | | | |
| | | | c-24 | B | | | A | A | B | B | B | A | | | | |
| THIRD ALLOY ACCORDING TO PRESENT INVENTION EX. | 41 | | c-25 | A | | | A | A | A | A | A | A | A | | | |
| | | | c-26 | B | | | A | A | A | A | A | A | | | | |
| | | | c-27 | A | | | A | A | A | A | A | A | | | | |
| | | | c-28 | A | | | A | A | A | A | A | A | | | | |
| | | | c-29 | A | | | A | A | B | A | A | A | | | | |
| | | | c-30 | A | | | A | B | A | B | A | A | | | | |
| | | | c-31 | B | | | B | A | B | A | B | A | | | | |

FIG. 12

| | ALLOY NO. | PRODUCTION PROCESS | TEST NO. | 20% COLD-ROLLED MATERIAL | | HOT ROLLING | HEAT TREATMENT | | | | HOT WORKABILITY | COLD WORKABILITY | TENSILE TEST (AFTER HEAT TREATMENT) | | | TENSILE TEST (20% COLD-ROLLED MATERIAL) | | |
|---|---|---|---|---|---|---|---|---|---|---|---|---|---|---|---|---|---|---|
| | | | | AREA RATIO (%) OF β PHASES | GRAIN SIZE (μm) | COOLING RATE IN 400°C TO 500°C (°C/sec) | MAXIMUM ACHIEVED TEMPERATURE Tmax (°C) | RETENTION TIME(min) | HEAT TREATMENT INDEX I1 | COOLING RATE IN 400°C TO 500°C (°C/sec) | | | STRENGTH (N/mm²) | ELONGATION (%) | TENSILE INDEX f2 | STRENGTH (N/mm²) | ELONGATION (%) | TENSILE INDEX f2 |
| FIRST ALLOY ACCORDING TO PRESENT INVENTION COMP. EX. | 12 | P3 | c-101 | 0.0 | 35 | 2.5 | 805 | 0.3 | 641 | 2.5 | A | A | 422 | 45 | 612 | 528 | 20 | 634 |
| | | | c-102 | 0.0 | 32 | 2.5 | 705 | 2 | 641 | 2.5 | A | B | 430 | 44 | 619 | 534 | 19 | 635 |
| | | | c-103 | 0.0 | 2 | 2.5 | 490 | 10 | 462 | 2.5 | A | A | 575 | 20 | 690 | 673 | 2.2 | 688 |
| | | | c-104 | 1.2 | 3 | 0.4 | 680 | 0.3 | 516 | 2.5 | A | C | 470 | 33 | 625 | 575 | 10 | 633 |
| | | | c-105 | 1.0 | 8 | 2.5 | 705 | 0.3 | 541 | 0.4 | A | A | 475 | 40 | 665 | 580 | 17 | 679 |
| | | | c-106 | WROUGHT STRUCTURE | | 2.5 | 760 | 0.09 | 460 | 2.5 | A | A | 596 | 24 | 739 | 700 | 1.3 | 709 |
| SECOND ALLOY ACCORDING TO PRESENT INVENTION COMP. EX. | 31 | | c-107 | 0.0 | 31 | 2.5 | 810 | 0.2 | 609 | 2.5 | A | A | 432 | 45 | 626 | 555 | 22 | 677 |
| | | | c-108 | WROUGHT STRUCTURE | | 2.5 | 505 | 5 | 465 | 2.5 | A | A | 635 | 9.3 | 694 | 712 | 1.5 | 742 |
| | | | c-109 | WROUGHT STRUCTURE | | 2.5 | 535 | 1.5 | 462 | 2.5 | A | A | 610 | 25 | 763 | 725 | 1.0 | 734 |
| | | | c-110 | 0.0 | 36 | 2.5 | 650 | 40 | 636 | 2.5 | A | A | 430 | 42 | 611 | 520 | 20 | 624 |
| | | | c-111 | 1.0 | 5 | 0.2 | 705 | 0.3 | 541 | 2.5 | A | C | 505 | 42 | 717 | 631 | 15 | 726 |
| | | | c-112 | 0.9 | 8 | 2.5 | 705 | 0.3 | 541 | 0.4 | A | A | 482 | 34 | 646 | 605 | 12 | 678 |
| | | | c-113 | 0.0 | 1 | 2.5 | 525 | 2 | 461 | 2.5 | A | A | 572 | 25 | 715 | 675 | 2.1 | 689 |
| | | | c-114 | 1.3 | 3 | 0.4 | 705 | 0.3 | 541 | 0.4 | A | C | 478 | 30 | 621 | 607 | 11 | 674 |
| | | | c-115 | 0.0 | 37 | 2.5 | 745 | 1 | 655 | 2.5 | A | A | 425 | 45 | 616 | 553 | 21 | 669 |
| | | | c-116 | WROUGHT STRUCTURE | | 2.5 | 745 | 0.09 | 445 | 2.5 | A | A | 601 | 23 | 739 | 715 | 1.8 | 728 |
| | | | c-117 | 0.0 | 34 | 2.5 | 625 | 100 | 616 | 2.5 | A | A | 435 | 46 | 635 | 549 | 15 | 631 |
| | | | c-118 | 1.2 | 36 | 2.5 | 765 | 0.5 | 638 | 0.4 | A | A | 422 | 36 | 574 | 558 | 10 | 614 |
| | 32 | | c-119 | 1.2 | 8 | 0.4 | 705 | 0.3 | 541 | 2.5 | A | C | 495 | 34 | 663 | 611 | 13 | 690 |
| | | | c-120 | 1.4 | 32 | 1.2 | 720 | 10 | 692 | 0.4 | A | B | 441 | 32 | 582 | 565 | 11 | 627 |
| | | | c-121 | 1.0 | 19 | 0.8 | 680 | 1 | 590 | 2.5 | A | C | 457 | 39 | 635 | 580 | 13 | 655 |
| | | | c-122 | 1.2 | 21 | 2.5 | 680 | 1 | 590 | 0.8 | A | A | 466 | 34 | 624 | 588 | 10 | 647 |
| | | | c-123 | 1.5 | 17 | 0.8 | 680 | 1 | 590 | 0.8 | A | C | 463 | 32 | 611 | 589 | 10 | 648 |
| | | | c-124 | 0.1 | 38 | 2.5 | 650 | 60 | 638 | 2.5 | A | A | 438 | 41 | 618 | 549 | 18 | 648 |
| THIRD ALLOY ACCORDING TO PRESENT INVENTION COMP. EX. | 41 | | c-125 | WROUGHT STRUCTURE | | 2.5 | 490 | 2 | 426 | 2.5 | A | A | 628 | 8.9 | 684 | 731 | 2 | 746 |
| | | | c-126 | 0.0 | 36 | 2.5 | 810 | 0.3 | 646 | 2.5 | A | A | 460 | 40 | 644 | 576 | 17 | 674 |
| | | | c-127 | WROUGHT STRUCTURE | | 2.5 | 705 | 0.09 | 405 | 2.5 | A | A | 620 | 12 | 694 | 732 | 1.5 | 743 |
| | | | c-128 | 0.0 | 31 | 2.5 | 600 | 95 | 591 | 2.5 | A | A | 454 | 38 | 627 | 577 | 16 | 669 |
| | | | c-129 | 1.5 | 8 | 0.4 | 705 | 0.3 | 541 | 0.8 | A | C | 495 | 41 | 698 | 609 | 13 | 688 |
| | | | c-130 | 1.1 | 7 | 0.8 | 705 | 0.3 | 541 | 2.5 | A | C | 505 | 42 | 717 | 622 | 14 | 709 |

FIG. 13

| | ALLOY NO. | PRODUCTION PROCESS | TEST NO. | BENDABILITY | WELDABILITY | | PRESS PROPERTY | BACTERICIDAL PROPERTY 1 | BACTERICIDAL PROPERTY 2 | COLOR FASTNESS TEST 1 | COLOR FASTNESS TEST 2 | CORROSION RESISTANCE | Ni ALLERGY RESISTANCE | WELDED PIPE (DRAWING) | | |
|---|---|---|---|---|---|---|---|---|---|---|---|---|---|---|---|---|
| | | | | | FLATTENING TEST | COLD DRAWING | | | | | | | | STRENGTH (N/mm²) | ELONGATION (%) | TENSILE INDEX f2 |
| FIRST ALLOY ACCORDING TO PRESENT NVENTION COMP. EX. | 12 | P3 | c-101 | C | | | C | A | A | B | A | A | | | | |
| | | | c-102 | C | | | C | A | A | A | B | A | | | | |
| | | | c-103 | D | | | A | A | A | A | A | A | | | | |
| | | | c-104 | D | | | A | B | B | B | A | A | | | | |
| | | | c-105 | B | | | A | B | B | C | B | A | | | | |
| | | | c-106 | D | | | A | A | A | B | B | A | | | | |
| SECOND ALLOY ACCORDING TO PRESENT INVENTION COMP. EX. | 31 | | c-107 | C | | | C | A | A | B | A | A | | | | |
| | | | c-108 | D | | | A | A | A | A | A | A | | | | |
| | | | c-109 | D | | | A | A | A | A | A | A | | | | |
| | | | c-110 | C | | | C | A | A | A | B | A | | | | |
| | | | c-111 | D | | | A | A | B | B | C | A | | | | |
| | | | c-112 | B | | | A | B | B | B | B | A | | | | |
| | | | c-113 | D | | | A | A | A | A | B | A | | | | |
| | | | c-114 | D | | | A | B | B | B | B | A | C | | | |
| | | | c-115 | C | | | C | A | A | B | B | A | | | | |
| | | | c-116 | D | | | A | A | A | B | A | A | | | | |
| | | | c-117 | C | | | C | A | B | A | B | A | | | | |
| | | | c-118 | D | | | C | B | B | B | C | C | | | | |
| | 32 | | c-119 | D | | | A | B | B | A | B | A | | | | |
| | | | c-120 | D | | | A | A | B | A | B | C | | | | |
| | | | c-121 | D | | | A | B | B | A | B | A | | | | |
| | | | c-122 | D | | | B | A | B | B | B | C | | | | |
| | | | c-123 | D | | | B | B | B | B | B | C | | | | |
| | | | c-124 | C | | | C | A | A | A | A | A | | | | |
| THIRD ALLOY ACCORDING TO PRESENT INVENTION COMP. EX. | 41 | | c-125 | D | | | A | A | B | B | A | A | | | | |
| | | | c-126 | C | | | C | A | A | A | B | A | | | | |
| | | | c-127 | D | | | A | A | A | A | A | A | | | | |
| | | | c-128 | C | | | C | A | A | A | A | A | | | | |
| | | | c-129 | D | | | A | A | B | B | B | C | | | | |
| | | | c-130 | D | | | A | A | B | B | A | A | | | | |

SILVER-WHITE COPPER ALLOY AND METHOD OF PRODUCING SILVER-WHITE COPPER ALLOY

This is a Continuation Application in the United States of International Patent Application No. PCT/JP2012/066356 filed Jun. 27, 2012, which claims priority on Japanese Patent Application No. P2011-143883, filed Jun. 29, 2011. The entire disclosures of the above patent applications are hereby incorporated by reference.

TECHNICAL FIELD

The present invention relates to a silver-white copper alloy and a method of producing a silver-white copper alloy. In particular, the present invention relates to a silver-white copper alloy which has high strength, superior workability such as hot workability, cold workability, or press property, superior mechanical properties, color fastness, superior bactericidal and antibacterial properties, and Ni allergy resistance; and a method of producing such a silver-white copper alloy.

BACKGROUND ART

In the related art, a copper alloy such as Cu—Zn is used for various uses such as piping materials, construction materials, electric and electronic apparatuses, daily necessaries, and mechanical parts. In addition, a white (silver-white) tone having color fastness is required for use in decorative and construction metal fittings such as railings and door knobs, western tableware, and keys. In order to satisfy such requirement, copper alloy products may be subjected to a plating treatment such as nickel-chrome plating.

However, such plated products have a problem that a plating layer on a surface thereof is peeled off after long-term use. In addition, the bactericidal and antibacterial properties of the copper alloy deteriorate. Therefore, a glossy white Cu—Ni—Zn alloy is proposed.

As such a Cu—Ni—Zn alloy, for example, JIS C 7941 specifies a free-cutting nickel silver containing Cu (60.0 mass % to 64.0 mass %), Ni (16.5 mass % to 19.5 mass %), Pb (0.8 mass % to 1.8 mass %), Zn (balance), and the like. In addition, Patent Document 1 discloses a white copper alloy containing Cu (41.0 mass % to 44.0 mass %), Ni (10.1 mass % to 14.0 mass %), Pb (0.5 mass % to 3.0 mass %), and Zn (balance). In addition, Patent Document 2 discloses a lead-free white copper alloy containing Cu (40.0 mass % to 45.0 mass %), Ni (5.0 mass % to 20.0 mass %), Mn (1.0 mass % to 10.0 mass %), Bi (0.5 mass % to 3.0 mass %), Sn (2.0 mass % to 6.0 mass %), and P and Sb (at least one kind; 0.02 mass % to 0.2 mass %).

However, since the copper alloys disclosed in JIS C 7941 and Patent Document 1 contain a large amount of Ni and Pb, there are problems pertaining to health and sanitation and thus, the use thereof is limited. Ni causes Ni allergy which is particularly severe among metal allergies, and Pb is a well-known harmful material. Therefore, there are problems for use in construction metal fittings such as railings, which may be touched by human skin, and daily necessities such as home appliances. In addition, when a large amount of Ni is contained, workability such as hot workability and press property deteriorates and, because Ni is expensive, the production cost is increased. Therefore, the use thereof is limited.

In addition, the copper alloy disclosed in Patent Document 2 does not contain Pb, which is harmful to human body, and improves workability (machinability) using Bi. However, Bi is a metal having a low melting point. Therefore, in the case of a copper alloy, since Bi is present in a matrix as the metal substantially without being dissolved therein, Bi is melted during hot rolling and there is a problem in hot workability. In addition, Ni, Sn, and Bi are expensive metals, and thus there are problems in terms of cost and production when these metals are added in large amounts.

In addition, in a Cu—Zn—Ni alloy plate disclosed in JIS H3110 (plates and strips of phosphor bronze and nickel silver) of the related art, 8.5 mass % or greater of Ni and mass % or greater of Cu are contained; or the Zn concentration is less than 30 mass %. Since a metal structure of such a plate is the $\alpha$ single-phase structure at a high temperature and normal temperature, hot workability is low. Therefore, such a Cu—Zn—Ni alloy is produced by casting an ingot with a cross-section having, for example, a thickness of about 15 mm and a width of about 400 mm without hot rolling; heating the ingot at a high temperature of about 700° C. for several hours; performing a homogenizing heat treatment for alleviating the segregation of components during casting; and repeating cold rolling and annealing. The productivity thereof is lower than that of an ingot for hot rolling with a cross-section having, for example, a thickness of about 200 mm and a width of about 800 mm. In addition, even when the homogenizing heat treatment is performed at a high temperature for a long period of time, the degree of segregation of alloy components is larger than that of a hot-rolled plate subjected to hot rolling, which causes a problem in quality. In particular, in a plate having, for example, a thickness of 1 mm or higher obtained through production processes in which an annealing process is performed only once or twice; a plate obtained through production processes in which an annealing process is performed multiple times and a retention time after heating at a recrystallization temperature or higher is shorter than 30 minutes; and a plate obtained through production processes in which an annealing time is long and an annealing temperature is lower than (recrystallization temperature+100° C.), the segregation is not eliminated.

In addition, a copper alloy is known to have bactericidal action. In medical institutions such as hospitals, there are cases in which a patient is infected with bacteria having resistance to drugs such as antibiotics, for example, *staphylococcus aureus* or *pseudomonas aeruginosa* (generally called hospital infection), which is a serious problem. There are many infection routes of bacteria through hospital infection. For example, bacteria spread by a patient with bacteria touching an object; and another patient or medical staff touching that touched object. It is expected that, by forming an object, which may be touched by patients or medical staffs, from a copper alloy, these bacteria are destroyed or reduced, infection routes are removed correspondingly, and thus hospital infection is reduced. For example, it is expected that, by forming knobs, lever handles, door handles, and the like, which are inside the hospital, from a copper alloy, infection routes of bacteria are reduced. In addition to the case of hospital infection, infections with various bacteria in public places such as trains, buses, or parks can be prevented by forming a component, which may be touched by an unspecified number of people, from a copper alloy having bactericidal and antibacterial properties.

However, when these knobs, lever handles, door handles, and the like formed from a copper alloy are used in practice, there is a difference in color tone between a portion, which are often touched by human body, and the other portions. In addition, after long-term use, since a discolored layer (oxide) is slowly formed in the portion which are often touched by human body or the portion is physically removed, the color tone thereof is different from that of the other portions (portions which are barely touched by human body). Accordingly, the external appearance looks bad. Therefore, since almost all the copper alloy knobs for these uses are used in a state where a copper alloy surface is coated with a plating film or a clear coating, the bactericidal and antibacterial properties of a copper alloy are not exhibited.

RELATED ART DOCUMENT

Patent Document

[Patent Document 1] JP-A-9-087793
[Patent Document 2] JP-A-2005-325413

DISCLOSURE OF THE INVENTION

Problem that the Invention is to Solve

The present invention has been made in order to solve the above-described problems of the related art, and an object thereof is to provide a silver-white copper alloy which has high strength, superior workability such as hot workability, cold workability, or press property, superior mechanical properties, color fastness, superior bactericidal and antibacterial properties, and Ni allergy resistance; and a method of producing such a silver-white copper alloy.

Means for Solving the Problems

In order to solve the above-described problems, the present inventors have investigated compositions and metal structures of a silver-white copper alloy and have found the following findings.

In a Cu—Zn—Ni alloy having a Cu concentration of 50 mass % or lower, a large amount of β phases appear during hot rolling although it depends on contents of Cu and Ni. As a result, the hot deformation resistance is low and the hot deformability is high. However, when an area ratio of β phases at normal temperature (room temperature) is greater than 0.9%, the ductility, the cold rolling property in the subsequent process, the color fastness, and the Ni allergy resistance are increased. Even when a Cu concentration is higher than 50 mass %, if a value of a composition index f1 described below is less than 65.5, a small amount of β phases appear during hot rolling. As a result, cracks are likely to be generated in phase boundaries between α phases in which the hot deformation resistance is high and the hot deformability is low and β phases in which the hot deformation resistance is low and the hot deformability is high. The reason is that, when an area ratio of β phases during hot rolling is approximately 1% to 5%, deformation is concentrated on the β phases and α-β phase boundaries and thus cracks are likely to be generated. When an area ratio of β phases in a hot-rolled plate at normal temperature (room temperature) is greater than 0.9%, the ductility and the cold rolling property in the subsequent process deteriorate.

β phases appearing in a Cu—Zn—Ni alloy are harder and more brittle than those appearing in other copper alloys, for example, a Cu—Zn alloy. In addition, α phases of a Cu—Zn—Ni alloy are superior in color fastness and corrosion resistance to those of a Cu—Zn alloy. However, β phases thereof are low in color fastness and corrosion resistance, and there is no significant difference between both alloys. When an area ratio of β phases in a metal structure of a Cu—Zn—Ni alloy is greater than 0.9%, there are adverse effects on ductility, balance between strength and ductility, color fastness, corrosion resistance, and Ni allergy resistance. It is preferable that the area ratio of β phases be less than 0.4%. It is most preferable that the area ratio of β phases be close to or equal to 0. A metal structure in which β phases are about to appear, as it is called, is preferable. In this state, the hot workability is high, the strength is highest, the ductility is high, the balance between strength and ductility is superior, the corrosion resistance, color fastness, bactericidal and antibacterial properties are superior, and the Ni allergy resistance is reduced. In the state in which β phases are about to appear, in a tensile test, the tensile strength and the proof stress reach almost the maximum point, the elongation value approaches almost the maximum value, and the balance between strength and ductility is superior. Furthermore, in a shearing treatment such as pressing, the press moldability is improved in the presence of a small amount of β phases or in a grain boundary state in which β phases are about to be precipitated. In order to efficiently use a small amount of C and Pb, the structure state in a boundary in which β phases are about to appear is preferable. That is, in order to efficiently precipitate C and Pb, the state in which β phases are about to be precipitated is effective.

The present invention has completed based on the above-described findings of the present inventors. That is, in order to solve the above-described problems, according to the present invention, there is provided a silver-white copper alloy containing: 51.0 mass % to 58.0 mass % of Cu; 9.0 mass % to 12.5 mass % of Ni; 0.0003 mass % to 0.010 mass % of C, 0.0005 mass % to 0.030 mass % of Pb; and the balance of Zn and inevitable impurities, in which a relationship of $65.5 \leq [Cu] + 1.2 \times [Ni] \leq 70.0$ is satisfied between a content of Cu [Cu] (mass %) and a content of Ni [Ni] (mass %), and in a metal structure thereof, an area ratio of β phases dispersed in an α-phase matrix is 0% to 0.9%.

According to the present invention, it is possible to obtain a silver-white copper alloy which has high strength, superior workability such as hot workability, cold workability, or press property, superior mechanical properties, color fastness, superior bactericidal and antibacterial properties, and Ni allergy resistance.

In addition, according to the present invention, there is provided a silver-white copper alloy containing: 51.0 mass % to 58.0 mass % of Cu; 9.0 mass % to 12.5 mass % of Ni; 0.05 mass % to 1.9 mass % of Mn; 0.0003 mass % to 0.010 mass % of C, 0.0005 mass % to 0.030 mass % of Pb; and the balance of Zn and inevitable impurities, in which a relationship of $65.5 \leq [Cu] + 1.2 \times [Ni] + 0.4 \times [Mn] \leq 70.0$ is satisfied between a content of Cu [Cu] (mass %), a content of Ni [Ni] (mass %), and a content of Mn [Mn] (mass %), and in a metal structure thereof, an area ratio of β phases dispersed in an α-phase matrix is 0% to 0.9%.

According to the present invention, the strength, bendability, press property of a silver-white copper alloy can be improved.

In addition, according to the present invention, there is provided a silver-white copper alloy containing: 51.5 mass % to 57.0 mass % of Cu; 10.0 mass % to 12.0 mass % of Ni; 0.05 mass % to 0.9 mass % of Mn; 0.0005 mass % to 0.008 mass % of C, 0.001 mass % to 0.009 mass % of Pb; and the balance of Zn and inevitable impurities, in which a relationship of $66.0 \leq [Cu] + 1.2 \times [Ni] + 0.4 \times [Mn] \leq 69.0$ is satisfied between a content of Cu [Cu] (mass %), a content of Ni [Ni] (mass %), and a content of Mn [Mn] (mass %), and in a metal structure thereof, an area ratio of β phases dispersed in an α-phase matrix is 0% to 0.4%.

According to the present invention, contents of Cu, Ni, Mn, C, and Pb are in preferable ranges and the area ratio of β phases is reduced. Therefore, it is possible to obtain a silver-white copper alloy which has high strength, superior workability such as hot workability, cold workability, or press property, superior mechanical properties, color fastness, superior bactericidal and antibacterial properties, and Ni allergy resistance.

It is preferable that the silver-white copper alloy further contain one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

According to such a preferable method, when Al, P, and Mg are contained, the strength, color fastness, and corrosion resistance are improved; and when Sb and As are contained, the corrosion resistance is improved.

In addition, according to the present invention, there is provided a method of producing a silver-white copper alloy, in which a cooling rate of a hot-rolled material in a temperature range of 400° C. to 500° C. is higher than or equal to 1° C./sec.

The area ratio of β phases in a α-phase matrix is easily adjusted to 0% to 0.9%.

In addition, according to the present invention, there is provided a method of producing a silver-white copper alloy, including: a heat treatment process of heating a rolled material to a predetermined temperature, maintaining the rolled material at a predetermined temperature for a predetermined time, and cooling the rolled material to a predetermined temperature, in which, when a maximum achieved temperature of the rolled material in the heat treatment process is represented by Tmax (° C.) and a retention time of the heat treatment process in a temperature range from a temperature, which is 50° C. lower than the maximum achieved temperature of the rolled material, to the maximum achieved temperature is represented by th (min), expressions of $520 \leq Tmax \leq 800$, $0.1 \leq th \leq 90$, and $470 \leq Tmax - 90 \times th^{-1/2} \leq 620$ are satisfied and a cooling rate during the cooling of the rolled material in a temperature range of 400° C. to 500° C. is higher than or equal to 1° C./sec. "Rolled material" described in the heat treatment process includes welded pipes formed from the rolled material.

The area ratio of β phases in a α-phase matrix is easily adjusted to 0% to 0.9%, and α-phase crystal grains are small, thereby obtaining a high mechanical strength.

Advantage of the Invention

According to the present invention, it is possible to obtain a silver-white copper alloy which has high strength, superior workability such as hot workability, cold workability, or press property, superior mechanical properties, color fastness, superior bactericidal and antibacterial properties, and Ni allergy resistance.

BRIEF DESCRIPTION OF THE DRAWINGS

FIG. 1 is a diagram illustrating compositions of a first alloy according to the present invention to a third alloy according to the present invention.

FIG. 2 is a diagram illustrating a composition of an alloy sample for comparison.

FIG. 4 is a diagram illustrating the results of tests in a production process P1.

FIG. 5 is a diagram illustrating the results of tests in the production process P1.

FIG. 6 is a diagram illustrating the results of tests in the production process P1.

FIG. 7 is a diagram illustrating the results of tests in the production process P1.

FIG. 8 is a diagram illustrating the results of tests in a production process P2.

FIG. 9 is a diagram illustrating the results of tests in the production process P2.

FIG. 10 is a diagram illustrating the results of tests in a production process P3.

FIG. 11 is a diagram illustrating the results of tests in the production process P3.

FIG. 12 is a diagram illustrating the results of tests in the production process P3.

FIG. 13 is a diagram illustrating the results of tests in the production process P3.

BEST MODE FOR CARRYING OUT THE INVENTION

Figure 3:
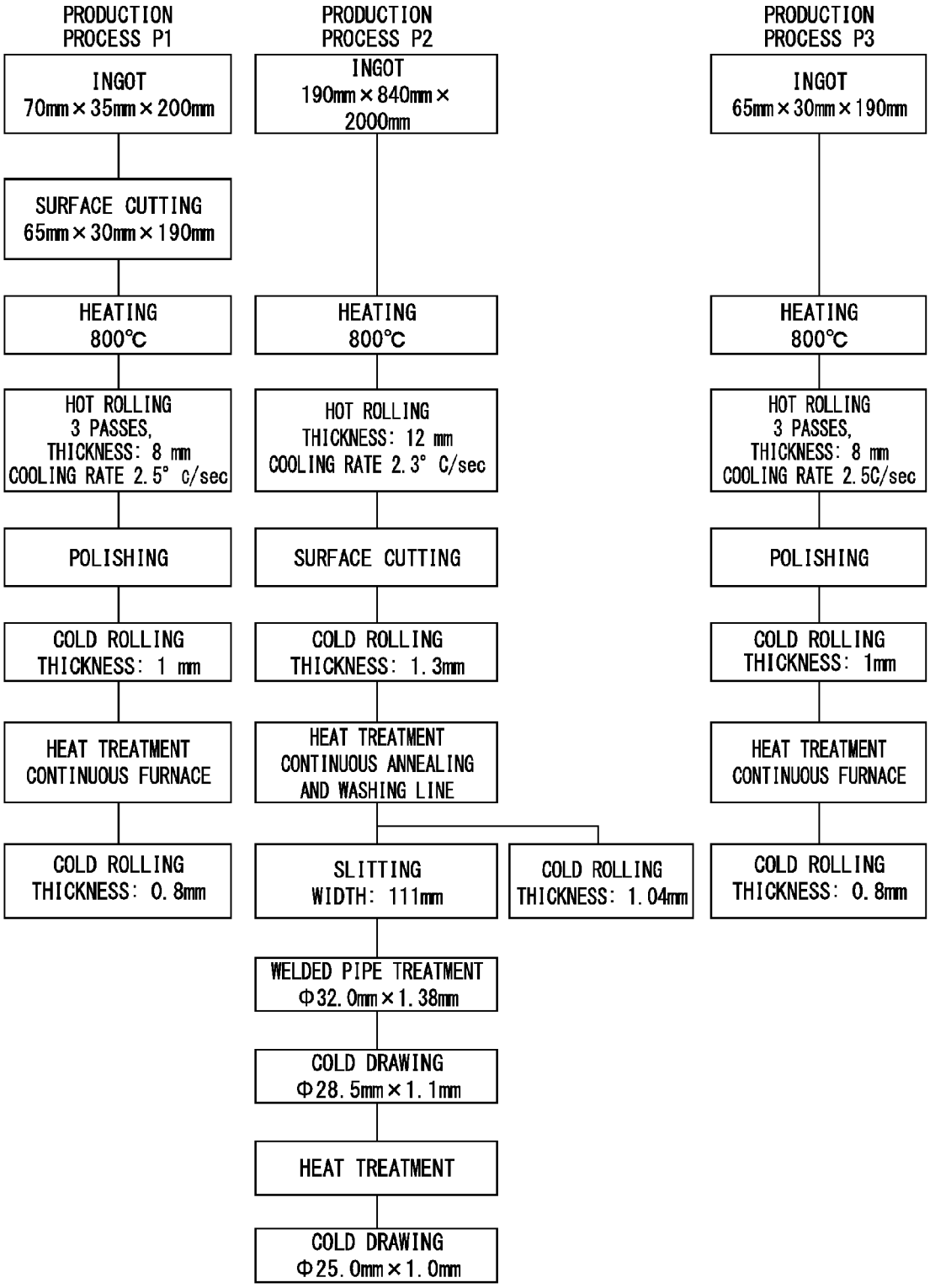
FIG. 3 is a flow chart illustrating production processes.

Silver-white copper alloys according to embodiments of the present invention will be described.

As the copper alloys according to the present invention, first to third alloys according to the present invention will be proposed. In this specification, when the alloy composition is expressed, the symbol for an element with square brackets such as [Cu] represents the content (mass %) of the element. In addition, in this specification, plural expressions will be described using this method of representing the content. In these expressions, when the element is not contained, the content is 0. In addition, the first to third alloys according to the present invention will be collectively called the alloys according to the present invention.

The first alloy according to the present invention contains 51.0 mass % to 58.0 mass % of Cu; 9.0 mass % to 12.5 mass % of Ni; 0.0003 mass % to 0.010 mass % of C, 0.0005 mass % to 0.030 mass % of Pb; and the balance of Zn and inevitable impurities, in which a relationship of $65.5 \leq [Cu]+1.2\times[Ni] \leq 70.0$ is satisfied between a content of Cu [Cu] (mass %) and a content of Ni [Ni] (mass %).

The second alloy according to the present invention contains 51.0 mass % to 58.0 mass % of Cu; 9.0 mass % to 12.5 mass % of Ni; 0.05 mass % to 1.9 mass % of Mn; 0.0003 mass % to 0.010 mass % of C, 0.0005 mass % to 0.030 mass % of Pb; and the balance of Zn and inevitable impurities, in which a relationship of $65.5 \leq [Cu]+1.2\times[Ni]+0.4\times[Mn] \leq 70.0$ is satisfied between a content of Cu [Cu] (mass %), a content of Ni [Ni] (mass %), and a content of Mn [Mn] (mass %).

The third alloy according to the present invention contains the same compositions of Cu, Ni, Mn, C, Pb, and Zn as those of the first or second alloy according to the present invention and further contains one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

In this specification, a composition index f1 is specified as follows as an index indicating the balance between the contents of Cu, Ni, and Mn.

$$f1=[Cu]+1.2\times[Ni]+0.4\times[Mn]$$

Next, production processes of the silver-white copper alloys according to the present invention will be described. The production processes include a hot rolling process. In the hot rolling process, a cooling rate of a hot-rolled material in a temperature range of 400° C. to 500° C. is higher than or equal to 1° C./sec.

In addition, at any time after the hot rolling process, a heat treatment process of heating a rolled material to a predetermined temperature, maintaining the rolled material at a predetermined temperature for a predetermined time, and cooling the rolled material to a predetermined temperature is performed. In this heat treatment process, when a maximum achieved temperature of the rolled material is represented by Tmax (° C.) and a retention time of the heat treatment process in a temperature range from a temperature, which is 50° C. lower than the maximum achieved temperature of the rolled material, to the maximum achieved temperature is represented by th (min), the following conditions (1) to (4) are satisfied.

(1) $520 \leq Tmax \leq 800$ (2) $0.1 \leq th \leq 90$ (3) $470 \leq It \leq 620$ (wherein a heat treatment index It is represented by $Tmax-90 \times th^{-1/2}$)

(4) A cooling rate in a temperature range of 400° C. to 500° C. is higher than or equal to 1° C./sec Next, the reason why each element is added will be described.

Cu is an important element for improving mechanical strengths such as tensile strength and proof stress and obtaining bactericidal and antibacterial properties and the like. When the content of Cu is less than 51.0 mass %, fragile β phases are precipitated, the ductility and color fastness deteriorate, and the bactericidal and antibacterial properties cannot be obtained although these actions also depend on the content of Ni. In addition, there is a problem of Ni allergy. Furthermore, the hot and cold rolling properties deteriorate and cracks are likely to be generated. In addition, β phases are likely to appear during the production of a welded pipe.

The content of Cu is greater than or equal to 51.0 mass %, preferably greater than or equal to 51.5 mass %, and most preferably greater than or equal to 52.0 mass %. On the other hand, when the content of Cu is greater than 58.0 mass %, the mechanical strength deteriorates and the workability such as hot rolling property or moldability deteriorates. In addition, the bactericidal and antibacterial properties deteriorate and Ni allergy is likely to occur although these actions also depend on the contents of Ni and Zn. The content of Cu is less than or equal to 58.0 mass %, preferably less than or equal to 57.0 mass %, and most preferably less than or equal to 56.0 mass %. In general, a copper alloy has superior bactericidal and antibacterial properties. However, it is known that the action thereof depends on the content of copper and that the content of copper is greater than or equal to 60 mass % and preferably greater than or equal to 70 mass %. The reason why superior bactericidal properties are exhibited even when the content of copper is less than or equal to 58 mass % as in the case of the present invention, is that Cu interacts with Zn and Ni. In addition, the value of the composition index f1 is important.

Zn improves mechanical strengths such as tensile strength and proof stress and workability; and improves silver-white properties and color fastness although these actions also depend on the content of Ni. In addition, Zn is an important element for obtaining the copper alloy properties of, for example, obtaining the bactericidal effect and reducing Ni allergy.

In addition, the content of Zn is preferably greater than or equal to 31.5 mass % and most preferably greater than or equal to 32.5 mass % from the viewpoints of bactericidal properties and Ni allergy resistance.

However, when the content of Zn is greater than or equal to 36.5 mass %, β phases appear, the ductility and color fastness deteriorate, and bactericidal and antibacterial properties are not obtained. In addition, β phases are likely to appear during the production of a welded pipe. The content of Zn is preferably less than or equal to 36.0 mass %. Meanwhile, when the content of Zn is less than 31 mass %, mechanical strengths deteriorate, hot workability and moldability deteriorate, and bactericidal and antibacterial properties deteriorate although these actions also depends on the contents of Ni and Cu. As a result, Ni allergy is likely to occur.

Ni is an important element for obtaining the white properties (silver-white properties) and color fastness of a copper alloy. However, when the content of Ni is greater than a given amount, the following defects are likely to be generated.

The fluidity during casting deteriorates.

A surface or edges are cracked during hot rolling.

Workability and press moldability deteriorate.

An allergy (Ni allergy) occurs.

However, when the content of Ni is small, the color tone and color fastness of a copper alloy deteriorate and the strength deteriorates. From these points of view, the content of Ni is greater than or equal to 9.0 mass %, preferably greater than or equal to 10.0 mass %, and most preferably greater than or equal to 10.5 mass %.

Meanwhile, from the viewpoint of the Ni allergy resistance and hot rolling property, the content of Ni is less than or equal to 12.5 mass %, preferably less than or equal 12.0 mass %, and most preferably less than or equal 11.5 mass %.

The contribution of Ni to bactericidal and antibacterial properties is small, and Ni may inhibit bactericidal and antibacterial properties in some cases. Therefore, the composition index f1 indicating the mixing ratio thereof to Cu and Zn is important. That is, when the contents of Cu, Zn, and Ni are in the above-described ranges and the expression of the composition index f1 is satisfied, bactericidal and antibacterial properties can be improved.

Mn serves as a Ni-substitution element for obtaining white properties with a slight yellowish tint although this action also depends on the mixing ratio thereof to Ni. In addition, Mn improves strength, wear resistance, bendability, and press property. On the other hand, when the content of Mn is too great, the hot rolling property is inhibited. The contribution of Mn alone to color fastness and bactericidal and antibacterial properties is small, and Mn may inhibit bactericidal and antibacterial properties in some cases. Therefore, the mixing ratio thereof to Cu, Zn, and Ni is important. In addition, when Mn is contained, the fluidity of molten metal is improved. From the point of view, the content of Mn is 0.05 mass % to 1.9 mass %, preferably 0.05 mass % to 0.9 mass %, and most preferably 0.5 mass % to 0.9 mass %.

When the contents of Cu, Ni, Mn, and Zn are determined, it is necessary that not only the respective contents of these elements but also the correlations between the contents of these elements be considered. In particular, the value of the composition index f1 is important for improving the mechanical strengths, the ductility, the balance between strength and ductility, the color fastness, the hot workability, the bactericidal and antibacterial properties, the Ni allergy resistance, the press property, the bendability, and the weldability during the production of a welded pipe. In this way, in order to obtain superior bactericidal and antibacterial properties in spite of a small content of copper, the correlations between Cu, Ni, and Mn, that is, the value of the composition index f1 is important.

Next, the composition index f1 will be described.

When the value of f1 ($f1=[Cu]+1.2\times[Ni]+0.4\times[Mn]$; wherein, in the case of a material to which Mn is not added, $[Mn]=0$, that is, $f1=[Cu]+1.2\times[Ni]$) is less than 65.5, the hot and cold rolling properties, color fastness, and bactericidal and antibacterial properties deteriorate and the Ni allergy property is increased.

In addition, when the value of composition index f1 is less than 65.5 during the production of a welded pipe, β phases remain in a joint portion and a portion, to which welding heat is applied, and β phases are likely to be remain after hot rolling. Therefore, the ductility during cold rolling deteriorates, which causes a problem in cold rolling property and cold drawability. In addition, the color fastness and bactericidal properties deteriorate and the Ni allergy property is increased. From these points of view, when the contents of Cu, Ni, and Mn are in the above-described ranges, the composition index f1 is greater than or equal to 65.5, preferably greater than or equal to 66.0, and most preferably greater than or equal to 66.5.

On the other hand, when the value of the composition index f1 is too great, the hot workability, workability such as press property, and weldability during welding deteriorate, the mechanical strengths are reduced, and the balance between strength and ductility deteriorates. In addition, when the value of the composition index f1 is too high, the bactericidal properties deteriorate. The value of the composition index f1 is less than or equal to 70.0, preferably less than or equal to 69.0, and most preferably less than or equal to 68.0. The range of the composition index f1 from 65.5 to 70.0 is set to the appropriate range of the composition index f1.

Pb and C are contained in order to improve the workability of a shearing treatment such as pressing, a polishing treatment, or the like. Most of Pb and C are not dissolved at normal temperature in a Cu—Zn—Ni alloy having an α single-phase metal structure. When the contents of Cu, Zn, Ni, and Mn are in the above-described ranges; the composition index f1 is in the appropriate range; and the heat treatment index It is from 470 to 620, Pb and C are precipitated mainly in a grain boundary during cooling after hot rolling, during the cooling of the heat treatment, during cooling after the welding of a welded pipe. Since Pb and C are finely precipitated as Pb particles and C particles, the workability of a shearing treatment such as pressing, a polishing treatment, or the like is improved.

In order to exhibit such an effect, the content of Pb is greater than or equal to 0.0005 mass % and preferably greater than or equal to 0.001 mass %. The content of C is greater than or equal to 0.0003 mass % and preferably greater than or equal to 0.0005 mass %. On the other hand, when the content of Pb or C is too great, there are adverse effects on the ductility, hot rolling property, and weldability of an alloy. The content of Pb is less than or equal to 0.030 mass %, preferably less than or equal to 0.015 mass %, and most preferably less than or equal to 0.009 mass %. In particular, since Pb is a harmful material, the less the better. The content of C is less than or equal to 0.010 mass % and preferably less than or equal to 0.008 mass %.

Next, Al, P, Sb, As, and Mg will be described.

In particular, Al, P, and Mg improve strength, color fastness, and corrosion resistance.

There are many cases in which scrap materials are used as a material of a copper alloy, and these scrap materials may contain S (sulfur) components. Mg can remove the S components in the form of MgS when such scrapes containing the S components are converted into an alloy material. Even if MgS remains in the alloy, there are no adverse effects on corrosion resistance. In addition, When the S components are converted into MgS, the press property is improved. When the scrapes containing the S component are used without Mg, S is likely to be present in a grain boundary of an alloy, which may cause grain-boundary corrosion. Therefore, color fastness deteriorates. However, in order for the addition of Mg to efficiently prevent grain-boundary corrosion and to exhibit the action thereof, it is necessary that the content of Mg be 0.001 mass % to 0.03 mass %. Mg is easily oxidized. Therefore, when an excess amount thereof is added, there is a concern that Mg is oxidized during casting to form an oxide; the viscosity of molten metal is increased; and casting defects such as oxide inclusion may occur.

P improves corrosion resistance and the fluidity of molten metal. In order to exhibit these effects, the content of P should be greater than or equal to 0.005 mass %. In addition, the content of P is preferably less than or equal to 0.09 mass % because an excess amount thereof may have adverse effects on the ductility during hot and cold rolling.

Sb and As are added in order to improve corrosion resistance as in the case of P. In order to obtain such an effect, it is necessary that the content of Sb or As be greater than or equal to 0.01 mass %. On the other hand, when the content thereof is greater than 0.09 mass %, the effect corresponding to the content is not obtained and the ductility is reduced. In addition, since Sb and As are harmful to human body, the content thereof is preferably less than or equal to 0.05 mass %.

Al has a function of removing S components although not being as superior as Mg and forms an oxide on a material surface to improve color fastness. In order to obtain such an effect, the content thereof should be greater than or equal to 0.01 mass %. On the other hand, when the content is greater than or equal to 0.3 mass %, the effect thereof is low, a firm oxide coating film is formed, and thus bactericidal and antibacterial properties are inhibited.

In the copper alloys according to the present invention, an area ratio of β phases in an α-phase matrix is 0% to 0.9% and preferably 0% to 0.4%; and a metal structure in which β phases are about to appear is preferable. However, it is necessary that α-phase grain boundaries and α-β phase boundaries be reinforced because the concentrations of Zn, Pb, C and other inevitable impurities, which promote the formation of β phases, are high and corrosion resistance and the like are unstable. To that end, it is necessary that Mg, Sb, As, P, Al, or Mn be added. In this case, β phases include β', phases which are generated in the order-disorder transformation.

Next, production processes will be described.

Even when a metal structure immediately after hot rolling is the α single-phase structure or contains an extremely small amount of β phases, if a cooling rate of a rolled material in a temperature range of 400° C. to 500° C. is slow in the process of cooling to normal temperature, a large amount of β phases are precipitated. In order to minimize the precipitation of β phases, it is preferable that the cooling rate of a hot-rolled material in a temperature range of 400° C. to 500° C. be higher than or equal to 1° C./sec. It is more preferable that the cooling rate be higher than or equal to 2° C./sec. When β phases remain in a hot-rolled material, in order to remove the β phases, it is necessary that the hot-rolled material be subjected to a heat treatment at a high temperature or for a long period of time in the heat treatment process. In addition, after cold rolling, even when a rolled material is subjected to a heat treatment at a high temperature of 520° C. or higher for a short period of time of about 0.1 minutes to 90 minutes, in order to minimize the precipitation of β phases, the cooling rate of the rolled material in a temperature range of 400° C. to 500° C. is preferably higher than or equal to 1° C./sec and more preferably higher than or equal to 2° C./sec. When a cold-rolled material is treated in a continuous annealing and washing line, the above-described heat treatment at a high temperature for a short period of time can be performed and the cooling rate in a temperature range of 400° C. to 500° C. can be increased. Therefore, the treatment in a continuous annealing and washing line is effective because the precipitation of β phases can be suppressed, various kinds of superior properties can be obtained, and a short period of time is required from the viewpoints of energy and productivity. In particular, during hot rolling, the segregation of elements Cu, Ni, and Zn generated during casting is not completely eliminated. Therefore, it is important that the heat treatment be performed at a high temperature for a short period of time to eliminate the segregation; the cooling rate be controlled to reduce the segregation; and the area ratio of β phases be adjusted to be less than or equal to 0.9% and preferably less than or equal to 0.4%, from the viewpoints of improving strength, ductility, corrosion resistance, and antibacterial property.

Conditions for continuous annealing are that a maximum achieved temperature is at a temperature of 520° to 800° C.; a retention time in a temperature range from a temperature, which is 50° C. lower than the maximum achieved temperature, to the maximum achieved temperature is 0.1 minutes to 90 minutes; and a relationship of $470 \leq It \leq 620$ is satisfied. It is preferable that the maximum achieved temperature be 540° C. to 780° C.; the retention time in a temperature range from a temperature, which is 50° C. lower than the maximum achieved temperature, to the maximum achieved temperature be 0.15 minutes to 50 minutes; and a relationship of $480 \leq It \leq 600$ be satisfied. When such conditions are satisfied during continuous annealing, preferable conditions for grain size described below can also be satisfied.

When the heat treatment index It is less than 470, that is, under the conditions that the maximum achieved temperature is lower or the retention time is shorter, a material is not sufficiently softened. As a result, a metal structure is not changed from a wrought structure, the heat treatment is not sufficiently performed, and the workability such as bendability deteriorates. On the other hand, when the heat treatment index It is greater than 620, a metal structure of a material is coarsened. As a result, the strength is significantly reduced, rough portions (surface roughening: the phenomenon in which convex and concave portions that can be observed by visual inspection are formed on a bent portion and a surface portion in the vicinity of the bent portion) are likely to be formed on the material during bending, and the workability such as punching quality deteriorates. Furthermore, the strength deteriorates and there are adverse effects on corrosion resistance. As the conditions, the heat treatment index It is more preferably greater than or equal to 480 and most preferably greater than or equal to 495. As the upper limit, the heat treatment index It is more preferably less than or equal to 600 and most preferably less than or equal to 580.

In order to sufficiently soften a material, the relationship between the maximum achieved temperature and the retention time represented by the heat treatment index It is important. In a treatment within a short period of time, it is necessary that the maximum achieved temperature be higher than or equal to 520° C. In addition, when a heat treatment is performed in a continuous annealing and washing line, a tension is applied to a rolled material to transport the rolled material in the continuous annealing and washing line. In this case, when the maximum achieved temperature of the rolled material is higher than 800° C. or 780° C., the rolled material may be drawn by the tension even for a short period of time.

In addition, a welded pipe is mainly used as a material for railings or door knobs. In a joint portion between welded pipes after welding and joining, in order to minimize the precipitation of β phases which have adverse effects on bendability, color fastness, and Ni allergy resistance, it is preferable that a cooling rate in a temperature range of 400° C. to 500° C. be higher than or equal to 1° C./sec during cooling after welding. It is more preferable that the cooling rate be higher than or equal to 2° C./sec. A case is assumed in which a welded pipe is produced under conditions that components of strip materials before welding, the expression (composition index f1) relating to the components, and the heat treatment conditions are satisfied; and the above-described cooling rate is satisfied after welding. In this case, when the heat treatment index It satisfies the above-described range as the heat treatment conditions during the heat treatment after welding or after welding and cold drawing; and an average cooling rate after the heat treatment in a temperature range of 400° C. to 500° C., which relates to the precipitation of β phases, is adjusted to be higher than or equal to 1° C./min and preferably higher than or equal to 2° C./min, an area ratio of β phases precipitated can be reduced to 0.9% or less or to 0.4% or less.

An average grain size affects punching quality, bendability, strength, corrosion resistance, and the like and is preferably 0.002 mm to 0.030 mm (2 μm to 30 μm). When the average grain size is greater than 0.030 mm, surface roughening (rough portions) occurs during bending. In addition, during punching, burrs and undercuts are increased and surface roughening occurs in the vicinity of a punching portion. Furthermore, since the strength is reduced, there are problems when the material is used for railings. In addition, there is a tendency that a reduction in weight cannot be realized and corrosion resistance deteriorates. The average grain size is preferably less than or equal to 0.020 mm and most preferably less than or equal to 0.010 mm. On the other hand, when the average grain size is less than 0.002 mm, there is a problem in bendability. The average grain size is preferably greater than or equal to 0.003 mm and most preferably greater than or equal to 0.004 mm. In the case of a welded pipe obtained by welding without performing cold drawing, the strength is required for its use. Therefore, the average grain size of strips of a material of the welded pipe is preferably 0.002 mm to 0.008 mm.

EXAMPLES

Using the above-described first to third alloys according to the present invention and copper alloys having compositions for comparison, samples were prepared by changing production processes. As the copper alloys for comparison, C2680 and C7060 specified according to JIS H 3100 and C7521 specified according to JIS H3110 were used.

FIGS. 1 and 2 illustrate the compositions of the first to third alloys according to the present invention and the copper alloys for comparison prepared as the samples.

The production processes of the samples include three processes of P1, P2, and P3. FIG. 3 illustrates configurations of the production processes P1, P2, and P3.

The production process P1 was performed as a laboratory test for the purpose of investigating the influence of the composition. The production process P2 was performed for the purposes of production in mass production facility and the investigation in a welded pipe. The production process P3 was performed as a laboratory test for the purpose of investigating the influence of conditions of hot rolling or a heat treatment.

The production process P1 was performed as follows.

A raw material, prepared by mixing various components of electrolytic copper, electrolytic zinc, high-purity Ni, and other commercially available pure metals, was melted in an electric furnace. Then, molten metal was poured into a mold having a size of 70 mm (width)×35 mm (thickness)×200 mm (length) to obtain a plate-shaped ingot of the test sample. In the plate-shaped ingot, a casting surface and oxides on the entire surface were removed by cutting to prepare a sample having a size of 65 mm (width)×30 mm (thickness)×190 mm (length). This sample was heated to 800° C. and was hot-rolled in three passes until a thickness of 8 mm was obtained. Then, forced air cooling was performed using air and a cooling fan to adjust a cooling rate in a temperature range of 400° C. to 500° C. to 2.5° C./sec. Oxides on the surface of the hot-rolled sample were removed by polishing, followed by cold rolling until a thickness of 1.0 mm was obtained. By changing the furnace setting temperature and feed rate in a nitrogen atmosphere using a continuous furnace (810A manufactured by Koyo Thermo Systems Co., Ltd.), a heat treatment was performed under adjusted conditions that a maximum achieved temperature was 705° C.; a retention time in a temperature range from a temperature, which was 50° C. lower than the maximum achieved temperature, to the maximum achieved temperature was 0.3 min; and a cooling rate in a temperature range of 400° C. to 500° C. was 2.5° C./sec. The heat treatment index It was 541. This heat treatment was performed assuming that mass products were produced in a continuous annealing and washing line and can be performed under the same heat treatment conditions as that in the continuous annealing and washing line. After the heat treatment, cold rolling was performed until a thickness of 0.8 mm (processing rate: 20%) was obtained, to prepare a sample.

The production process P2 was performed as follows.

A raw material prepared by mixing predetermined components was melted in a channel type low frequency induction heating furnace to prepare a plate-shaped ingot having a thickness of 190 mm, a width of 840 mm, and a length of 2000 mm. This ingot was heated to 800° C. and was hot-rolled until a thickness of 12 mm was obtained. The hot-rolled material was cooled by forced air cooling using a cooling fan and shower water cooling in which a cooling rate in a temperature range of 400° C. to 500° C. was 2.3° C./sec. The surface of the rolled material was cut (thickness: 11.2 mm), followed by cold rolling until a thickness of 1.3 mm was obtained. Materials were prepared under various heat treatment conditions (the maximum achieved temperature of the heat treatment material; and the retention time in a temperature range from a temperature, which was 50° C. lower than the maximum achieved temperature, to the maximum achieved temperature) by changing the furnace setting temperature and feed rate in a continuous annealing and washing line. The maximum achieved temperature of the heat treatment material was 680° C. to 730° C.; the retention time in a temperature range from a temperature, which was 50° C. lower than the maximum achieved temperature, to the maximum achieved temperature was 0.25 min to 0.5 min; and the cooling rate in a temperature of 400° C. to 500° C. was 0.3° C./sec to 2.3° C. The heat treatment index It was 525 to 593. The heat treatment material was cut into a width of 111 mm by a slitter to prepare a strip (material) of a welded pipe.

In order to prepare a welded pipe, the material (heat treatment material of 111 mm (width)×1.3 mm (thickness) was fed at a feed rate of 60 m/min and was subjected to plastic working using plural rolls to obtain a cylindrical shape. The cylindrical material was heated using a high-frequency induction heating coil to join and weld both ends of the strip. A bead portion of the joint portion was removed by cutting using a turning tool (cutting tool). As a result, a welded pipe having a diameter of 32.0 mm and a thickness of 1.38 mm was obtained. Due to the change of the thickness, when a welded pipe was molded, a several percentage of cold rolling was performed in practice. After welding, the cooling rate in a temperature range of 400° C. to 500° C. was 2.7° C./sec. A part of the welded pipe was cold-rolled to obtain a diameter of 28.5 mm and a thickness of 1.1 mm. The welded pipe was cut into a length of 300 mm. By changing the furnace setting temperature and feed rate in a nitrogen atmosphere using a continuous furnace (810A manufactured by Koyo Thermo Systems Co., Ltd.), a heat treatment (heat treatment index It: 584) was performed under conditions that a maximum achieved temperature was 600° C.; a retention time in a temperature range from a temperature, which was 50° C. lower than the maximum achieved temperature, to the maximum achieved temperature was 30 min; and a cooling rate in a temperature range of 400° C. to 500° C. was 2.5° C./sec. Final cold drawing was performed to obtain a pipe material having a diameter of 25.0 mm and a thickness of 1.0 mm (draw ratio: 20.4%).

In addition, after the heat treatment in the continuous annealing and washing line, the rolled material was cold-rolled into a thickness of 1.04 mm (processing ratio: 20%) in order to evaluate various properties.

In addition, for comparison, commercially available C2680 (65Cu-35Zn), C7060 (90Cu-10Ni), and C7521 (Cu-19Zn-17Ni) having a thickness of 1 mm were purchased. By changing the furnace setting temperature and feed rate in a nitrogen atmosphere using a continuous furnace, a heat treatment (heat treatment index It: 541) was performed under adjusted conditions: a maximum achieved temperature of 705° C.; a retention time in a temperature range from a temperature, which was 50° C. lower than the maximum achieved temperature, to the maximum achieved temperature of 0.3 min; and a cooling rate in a temperature range of 400° C. to 500° C. of 2.5° C./sec. Each commercially available heated material was cold-rolled until a thickness of 0.8 mm (processing ratio: 20%) was obtained.

The production process P3 was performed as follows.

A sample having a size of 65 mm (width)×30 mm (thickness)×190 mm (length) was cut from the plate-shaped ingot of the production process P2, was heated to 800° C., and was hot-rolled in three passes until a thickness of 8 mm was obtained. Then, forced air cooling was performed using air and a cooling fan to adjust a cooling rate in a temperature range of 400° C. to 500° C. to 0.2° C./sec to 2.5° C./sec. Oxides on the surface of the hot-rolled sample were removed by polishing, followed by cold rolling until a thickness of 1.0 mm was obtained. By changing the furnace setting temperature and feed rate in a nitrogen atmosphere using a continuous furnace (810A manufactured by Koyo Thermo Systems Co., Ltd.), a heat treatment was performed under adjusted conditions of a maximum achieved temperature; a retention time in a temperature range from a temperature, which was 50° C. lower than the maximum achieved temperature, to the maximum achieved temperature; and a cooling rate. The maximum achieved temperature of the sample was 490° C. to 810° C.; the retention time in a temperature range from a temperature, which was 50° C. lower than the maximum achieved temperature, to the maximum achieved temperature was 0.09 min to 100 min; and the cooling rate in a temperature range of 400° C. to 500° C. was 0.4° C./sec to 2.5° C./sec. The heat treatment index It was 405 to 692. After the heat treatment, the sample was cold-rolled into a thickness of 0.8 mm (processing ratio: 20%).

The samples prepared in the above-described production processes were evaluated using the following methods.

<Color Tone and Color Difference>

A surface color (color tone) of the copper alloy was measured using a object color measurement method specified in JIS Z 8722-2009 (Methods of color measurement-Reflecting and transmitting objects) and was represented by the L*a*b* color system specified in JIS Z 8729-2004 (color specification-L*a*b* color space and L*u*v* color space). Specifically, values of L, a, and b were measured using a spectrophotometer "CM-2002" manufactured by Konica Minolta Inc. with SCI (specular component included). The color difference ($\Delta E=\{(\Delta L^*)^2+(\Delta a^*)^2+(\Delta b^*)^2\}^{1/2}$; wherein $\Delta L^*$, $\Delta a^*$, and $\Delta b^*$ are the difference between two object colors) according to JIS Z 8730 (Color Specification-Color Difference of Object Colors) was calculated from the respective L*a*b* values measured before and after the test. The magnitude of the color difference was evaluated. In order to obtain the L*a*b* values measured before and after the test, the measurement was performed at three points and the average value thereof was used.

<Color Fastness Test 1: Artificial Perspiration Spray Test>

In a color fastness test for evaluating the color fastness of the material, a test solution of JIS Z 2371 (Methods of salt spray testing) was used as an artificial perspiration solution (acidic artificial perspiration solution specified in JIS L 0848 (Test method for color fastness to perspiration); prepared by dissolving 0.5 g of L-Histidine hydrochloride monohydrate, 5 g of sodium chloride, and 2.2 g of sodium dihydrogenphosphate dehydrate in water and adding 0.1 mol/L sodium hydroxide and water thereto to obtain a total amount of 1 L and a pH of 5.5). Using a combined-cyclic corrosion test instrument (manufactured by Itabashi Rikakogyo Co., Ltd., BQ-2 type), the temperature of a spray chamber was maintained at 35±2° C. and the temperature of a test solution storage tank was maintained at 35±2° C. The spray liquid was fed through a spray nozzle using compressed air (0.098±0.010 MPa). The artificial perspiration was continuously supplied to a sample placed in the spray chamber (20% cold-rolled material: 150 mm (vertical)×50 mm (horizontal)). The test time was 8 hours. After the test, the sample was taken out, was washed with water, and was dried with a blower. The color of a sample surface was measured using a spectrophotometer (CM-2002, manufactured by Konica Minolta Inc.) with L*a*b* specified in JIS Z 8729. The color difference ($\Delta E=\{(\Delta L^*)^2+(\Delta a^*)^2+(\Delta b^*)^2\}^{1/2}$; wherein $\Delta L^*$, $\Delta a^*$, and $\Delta b^*$ are the difference between two object colors) according to JIS Z 8730 was calculated from the respective L*a*b* values measured before and after the test. The magnitude of the color difference was evaluated. As the color difference is less, the change in color tone is less, which represents that the color fastness is high. For the evaluation for color fastness, the color difference values were classified into "A: 0 to 4.9", "B: 5 to 9.9", and "C: 10 or greater". The color difference represents the difference between the respective measured values before and after the test. As the value thereof is greater, the change in color tone before and after the test is greater. When the color difference is greater than or equal to 10, discoloration can be sufficiently confirmed by visual inspection and it can be determined that color fastness is low. For comparison, regarding the commercially available C2680 (65/35 brass), C7060 (cupronickel; Cu-10Ni alloy), and C7521 (Cu-19Zn-17Ni alloy; high Ni alloy) as the copper alloys for comparison, the same evaluation for color fastness was performed. C2680 was subjected to a rust prevention treatment (treatment using a commercially available copper alloy rust prevention solution) which is performed by a general copper alloy manufacturer. In the rust prevention treatment, a surface of the C2680 material was degreased with acetone and was dipped for 10 seconds in an aqueous solution, which was heated to 75° C. and contained 0.1 vol % of commercially available copper alloy rust prevention solution having benzotriazole as a major component, followed by washing with water, hot-water washing, and drying with a blower. As a result, a material was obtained. The above-described conditions are the same as rust prevention treatment conditions (mass production) of a general copper alloy. In addition, regarding C7060 and C7521, as in the case of the alloys according to the present invention, the exposure test was performed without using a rust inhibitor.

<Color Fastness Test 2: Indoor Exposure Test>

Assuming that a plate having a size of 150 mm (vertical)× 50 mm (horizontal), which was cut from the 20% cold-rolled material, was actually used as a push plate, the plate was attached to a door inside the building of Sambo plant, Mitsubishi Shindoh Co., Ltd. to investigate the discoloration state of the surface. The surface of this sample was polished with a dry method using a #1200 waterproof abrasive paper before exposure and was exposed to room temperature (air-conditioned) for 1 month. This push plate was used under conditions that the plate was touched by a human hand at least 100 times per day (the contact time per one time was about 1 second). The surface color of a material before and after the exposure was measured using a spectrophotometer with L*a*b*. The color difference was calculated and evaluated. Using the same evaluation criteria as those in the artificial perspiration spray test, the color difference values were classified into "A: 0 to 4.9", "B: 5 to 9.9", and "C: 10 or greater". For comparison, regarding C2680 subjected to the rust prevention treatment and c7060 and C7521, the same exposure test was performed for the evaluation.

<Nickel Allergy Resistance>

A copper alloy plate having a size of 10 mm×10 mm, which was cut from the 20% cold-rolled material, was attached to an upper arm of a healthy subject (who had not suffered from contact dermatitis by metal) using a patch test plaster (manufactured by Torii Pharmaceutical Co., Ltd.). The copper alloy plate was removed after 8 hours. Whether or not allergic reactions (allergic reactions of which symptoms such as erythema or eczema can be observed by visual inspection) occur in the contact portion between the human body and the copper alloy plate was determined. Cases where the allergic reactions did not occur are represented by "A"; and cases where the allergic reactions occurred are represented by "C".

<Press Property>

A press punching test was performed using a punching tool, equipped with a punch and a die having a diameter of 57 mm and using a 200 kN hydraulic system universal testing machine (AY-200SIII-L, manufactured by Tokyo Testing Machine Mfg Co., Ltd.). A copper alloy plate was held in a die upper portion having a circular hole and punched in a direction from an upper portion to a lower portion at a rate of 5 mm/sec. SKS-3 was used as a material of the punch and the die, a clearance with the punch was 3%, a trimming die taper was 0° C., and the test was performed without lubrication. The 20% cold-rolled material was used for the evaluation.

A sample having a width of 5 mm and a length of 10 mm was cut out from an end of the copper alloy plate which was punched in a circular shape having a diameter of ϕ57 mm. This sample was embedded with a resin and was vertically observed from the end portion of the copper alloy plate using a metallographic microscope to measure the burr height. The punched sample was measured at 4 points divided in the 90° direction, and the average value was calculated as "burr height". As the "burr height" is lower, the evaluation for press property (punching quality) was higher. The press property was evaluated based on the measured value of "burr height". The criteria for the evaluation of the press property (punching quality) are "A: less than 5 μm", "B: 5 μm to 10 μm", and "C: 10 μm or greater". As the burr height is less, the press property is higher. When the burr height is "A: less than 5 μm", the press property can be determined to be high.

<Bendability>

A sample was bent by 180° according to JIS Z 2248 (metallic material bend test method) and the bendability was determined based on the state of the bent portion. In the 180° bending test, a 20% cold-rolled sample having a thickness of 0.8 mm (1.04 mm in the case of 20% cold rolling of the production process P2) was used; the bend radius (R) of the bent portion was set to 0.4 mm (0.52 mm in the case of 20% cold rolling of the production process P2); and the sample was bent by 180° C. so as to satisfy an expression of R/ta=0.5 (ta represents the thickness). The bent portion (curved portion) was observed by visual inspection and the evaluation was performed based on the following criteria: "A: No wrinkles or a small amount of wrinkles were observed"; "B: a large amount of wrinkles were observed"; "C: rough portions were formed"; and "D: cracks were formed".

In the case of "A: No wrinkles or a small amount of wrinkles were observed" which causes substantially no problems during the bending of a connector or the like, it can be determined that the Bendability is superior. The evaluation of B or higher in which there are no cracks is preferable. When the size of wrinkles was difficult to determine by visual inspection, the bent portion (curved portion) was observed using an optical microscope at a magnification of 50 times as described in the standard test method of bend formability for sheets and strips of copper and copper alloys of JBMA (Japan Brass Makers Association standard) T307:1999. In addition, when a material is bent such that the crystal grains thereof are coarse, there are no cracks in the vicinity of the bent portion; however, a large amount of rough portions (surface roughening) are formed. As a result, this material cannot be used. The sample in which rough portions were formed was evaluated as "C".

<Weldability>

A welded pipe was produced with a method in which a strip product as a general material was gradually subjected to plastic working by forming rollers in the width direction to be molded into a circular shape; and was heated by a high-frequency induction heating coil to join and weld both ends thereof. The joint portion was subjected to so-called pressure welding portion. In the joint portion, a large bead portion was formed from a surplus butting portion of the material. The welding bead portions inside and outside the pipe were continuously removed by cutting using a cutting tool. The welding portion has a problem in joinability due to the adhesion of the butting portion. The weldability was evaluated in flattening test described in JIS H 3320 (Copper and copper alloy welded pipes and tubes). That is, a sample having a size of about 100 mm was obtained from an end of a welded pipe. This sample was interposed between two plates and was pressed until the distance between the plates was three times the thickness of the pipe. At this time, a welding portion of the welding pipe was placed in a direction perpendicular to a pressing direction and was bent flat so as to be a bent tip end. The state of the bent welding portion was observed by visual inspection. In addition, a welded pipe material (not a cold-drawn pipe material) was used for flat bending. The evaluation criteria are "A: defects such as cracks or fine holes were not observed"; "B: fine cracks were not observed (the length of open cracks in a longitudinal direction of the pipe material was less than 2 mm); and "C: cracks are partially observed (the length of open cracks in a longitudinal direction of the pipe material was greater than or equal to 2 mm).

In addition, the soundness of the welding portion was investigated when being cold-drawn. One cold-drawn welded pipe was among cold-drawn pipes having an outer diameter of 28.5 mm, a thickness of 1.1 mm, and a length of 4000 mm, and a welding portion thereof was observed by visual inspection over the entire length. Cases where there were no cracks and the welding portion was sound were evaluated as "A" and cases where cracks were observed by visual inspection or cold rolling could not be performed (the welded pipe was fractured from the welding portion during cold rolling) were evaluated as "C".

<Grain Size>

Regarding the 20% cold-rolled sample (in the production processes P1 and P3, the material having a thickness of 0.8 mm subjected to cold-rolling after the heat treatment; in the production process P2, the material having a thickness of 1.04 mm subjected to cold-rolling after the heat treatment; hereinbelow, the same shall be applied), the grain size was measured with a method in which a metal structure of a cross-section in a direction parallel to a rolling direction was observed using a metallographic microscope (EPIPHOT 300 manufactured by Nikon Corporation) at a magnification of 150 times (appropriately changed up to 500 times according to the grain size); and the grain size of α phases in the observed metal structure was measured according to the comparison method of JIS H 0501 (methods for estimating average grain size of wrought copper and copper-alloys). In order to obtain the grain size (grain size of α phases), the measurement was performed at three arbitrary points and the average value thereof was used.

<Area Ratio of β Phases>

The area ratio of β phases was obtained as follows. A metal structure of a cross-section of the 20% cold-rolled sample in a direction parallel to a rolling direction was observed using a metallographic microscope (EPIPHOT 300 manufactured by Nikon Corporation) at a magnification of 500 times; β phases in the observed metal structure were binarized using an image processing software "WinROOF"; and the area ratio of β phases to the total ratio of the entire metal structure (portions of the metal structure other than β phases were α phases) was obtained. The metal structure was observed from three visual fields, and the average value of the respective area ratios was calculated.

When β phases were difficult to discriminate with a metallographic microscope at a magnification of 500 times, the area ratio was obtained by FE-SEM-EBSP (Electron Back Scattering diffraction Pattern). That is, JSM-7000F (manufactured by JEOL Ltd.) was used as a FE-SEM; TSL solutions OIM Ver. 5.1 was used for the analysis; and the area ratio was obtained from a phase map at an analysis magnification of 2000 times. That is, since the α phase represents a crystalline structure of FCC and the β phase represents a crystalline structure of BCC, both phases can be discriminated from each other.

<Hot Workability>

The hot workability is evaluated based on the crack state after hot rolling. The appearance was observed by visual inspection, and materials where no defects such as cracks by hot rolling were observed or where cracks were observed but the size thereof was small (3 mm or less) were determined to be superior in practice and were evaluated as "A"; materials where the number of small cracked edges having a size of 5 mm or less over the entire length was 5 or less were determined to be practicable and were evaluated as "B"; and materials where a large crack having a size of greater than 5 mm was observed and/or where the number of small cracks having a size of 3 mm or less was more than 6 were determined to have a problem in practice (to require a large repair in practice) and were evaluated as "C". For the materials which were evaluated as "C", the following tests were stopped.

<Cold Workability>

The cold workability is evaluated based on the crack state (the crack state of the cold-rolled material) after the hot-rolled material was cold-rolled at a high processing ratio of 80% or higher. The appearance was observed by visual inspection, and materials where no defects such as cracks were observed or where cracks were observed but the size thereof was small (3 mm or less) were determined to be superior in practice and were evaluated as "A"; materials where cracked edges having a size of greater than 3 mm and 5 mm or less were observed were determined to be practicable and were evaluated as "B"; and materials where a large crack having a size of greater than 5 mm was observed were determined to have a problem in practice (to require a large repair in practice) and were evaluated as "C". In this evaluation, cracks formed by an ingot were excluded, cracks which could be determined by visual inspection that they were formed during hot rolling were excluded, and cracks formed during cold rolling were determined based on the length thereof. For the alloys which were evaluated as "C", the following tests were stopped.

<Bactericidal Property (Antibacterial Property) 1>

The bactericidal property was evaluated with a test method referring to JIS Z 2801 (antimicrobial products—test for antimicrobial activity and efficacy) and the test area (film area) and the contact time were changed to conduct evaluation. *Escherichia coli* (stock No. of strain: NBRC3972) was used as bacteria for the test. A solution, which was obtained by precultivating (as the preculture method, a method described in 5.6.a of JIS Z 2801 was used) *escherichia coli* at 35±1° C. and diluting *escherichia coli* with 1/500NB to adjust the number of bacteria to $1.0\times10^6$ cells/mL, was used as a test bacterial suspension. In the test method, a sample cut into a 20 mm×20 mm square shape was put into a sterilized petri dish, 0.045 mL of the above-described test bacterial suspension (*escherichia coli*: $1.0\times10^6$ cells/mL) was added dropwise thereto, and the petri dish was covered with a ϕ15 mm film. The test bacterial suspension was cultivated for 10 minutes (inoculation time: 10 minutes) in this petri dish in an atmosphere of 35±1° C. and a relative humidity of 95%. This cultivated test bacterial suspension was washed away with 10 mL of SCDLP culture medium to obtain a wash-away bacterial suspension. The wash-away bacterial suspension was diluted to 10 times with phosphate buffered saline solution. Standard plate count agar was added to this bacterial suspension, followed by cultivation at 35±1° C. for 48 hours. When the number of colonies was more than or equal to 30, the number of colonies was measured to obtain the viable bacterial count (cfu/mL). The viable bacterial count of each sample was compared to the viable bacterial count at the time of inoculation (the viable bacterial count when the test for bactericidal property started; cfu/mL). The evaluation criteria were "A: 20% or lower", "B: 20% to less than 50%", and "C: 80% or higher". For samples which were evaluated as A (That is, the viable bacterial count was less than ⅕ of the viable bacterial count at the time of inoculation), the antibacterial property was evaluated to be superior. The reason why the culture time (inoculation time) was short at 10 minutes is that the immediate activity for bactericidal and antibacterial properties was evaluated. As the evaluated samples, the 20% cold-rolled materials were used.

<Bactericidal Property (Antibacterial Property) 2>

After the measurement of the object color, the exposed material (which was exposed for 1 month as the push plate of the door inside the building of Sambo plant, Mitsubishi Shindoh Co., Ltd.) of the above-described color fastness test 2 was cut into a 20 mm×20 mm square shape. The bactericidal property test was performed using the above-described test bacterial suspension of *escherichia coli* to evaluate the sample after long-term use for bactericidal property. The test method and evaluation method are the same as those of Bactericidal Property (Antibacterial Property) 1.

<Corrosion Resistance>

The corrosion resistance was evaluated in a dezincification corrosion test according to ISO6509:1981 (corrosion of metals and alloys determination of dezincification resistance of brass). In the test, a sample was held in 1% copper (II) chloride solution, heated to 75° C., for 24 hours. A metal structure of the sample in a direction perpendicular to an exposed surface was observed to measure the depth of a portion where dezincification corrosion advanced most (maximum dezincification corrosion depth). Samples where the maximum dezincification corrosion depth was less than or equal to 200 μm were evaluated as "A"; and samples where the maximum dezincification corrosion depth was greater than 200 μm were evaluated as "C".

The 20% cold-rolled sample (in the production processes P1 and P3, the material having a thickness of 0.8 mm subjected to cold-rolling after the heat treatment; in the production process P2, the material having a thickness of 1.04 mm subjected to cold-rolling after the heat treatment; hereinbelow, the same shall be applied) was used.

<Tensile Test>

Each of the rolled material after the heat treatment (sample before cold rolling) and the 20% cold-rolled material was processed into No. 5 test piece (width: 25 mm, gauge length: 25 mm) specified in JIS Z 2201 (Test pieces for tensile test for metallic materials). The tensile test was performed using a 200 kN hydraulic system universal testing machine (AY-200SIII-L, manufactured by Tokyo Testing Machine Mfg Co., Ltd.). In addition, each of the welded pipe (diameter: 32.0 mm, thickness: 1.38 mm) and the cold-drawn welded pipe (diameter: 25 mm, thickness: 1 mm) was processed into No. 11 test piece (gauge length: 50 mm; the state where the test piece was cut from the pipe material) specified in JIS Z 2201 (Test pieces for tensile test for metallic materials). A cored bar was inserted into a grip portion and the tensile test was performed using a 200 kN hydraulic system universal testing machine (AY-200SIII-L, manufactured by Tokyo Testing Machine Mfg Co., Ltd.).

In addition, when the tensile strength is represented by $\sigma$ ($N/mm^2$) and the elongation is represented by $\epsilon$ (%), a tensile index f2 as the index indicating the balance between strength and ductility was defined as $f2=\sigma\times(1+\epsilon/100)$.

The results of the above-described respective tests are shown in FIGS. 4 and 13. Here, the results of each sample for the respective tests are shown in two drawings of FIGS. 4 and 5, FIGS. 6 and 7, FIGS. 8 and 9, FIGS. 10 and 11, and FIGS. 12 and 13.

Here, in the item "Heat Treatment" of the production process P2, the conditions for the heat treatment performed after cold rolling of 1.3 mm are shown. In addition, in the item "Tensile Test (After Heat Treatment)" of the production process P2, the results for the heat treatment performed after cold rolling of 1.3 mm are shown. In addition, in the item "Tensile Test (20% Cold-Rolled Material)", the results after cold-rolling of 0.8 mm are shown for the production processes P1 and P3; and the results after cold-rolling of 1.04 mm are shown for the production process P2.

The following was found from the results of the tests.

In the silver-white copper alloys as the first alloys according to the present invention having a metal structure in which the area ratio of β phases dispersed in an α-phase matrix was 0% to 0.9%, the mechanical properties such as hot workability, cold workability, and press property were superior, the color fastness was high, and the bactericidal and antibacterial properties and Ni allergy resistance were superior (for example, refer to Test No. a-1). In the silver-white copper alloys having a metal structure in which the area ratio of β phases dispersed in an α-phase matrix was 0 to 0.4%, the properties were particularly high.

In the silver-white copper alloys as the second alloys according to the present invention having a metal structure in which the area ratio of β phases dispersed in an α-phase matrix was 0% to 0.9%, the strength, bendability, and press property were further improved (for example, refer to Test No. a-13). In the silver-white copper alloys having a metal structure in which the area ratio of β phases dispersed in an α-phase matrix was 0 to 0.4%, the properties were particularly high.

In the silver-white copper alloys as the third alloys according to the present invention having a metal structure in which the area ratio of β phases dispersed in an α-phase matrix was 0% to 0.9%, the strength, color fastness, and corrosion resistance were improved in the case of alloys having Al, P, or Mg; and the corrosion resistance was improved in the case of alloys having Sb or As (for example, refer to Test No. a-33, a-35, a-36, a-37, and a-38).

When the cooling rate of the hot-rolled material in a temperature range of 400° C. to 500° C. is higher than or equal to 1° C./sec, the area ratio of β phases dispersed in an α-phase matrix is likely to be in 0% to 0.9% (for example, refer to Test No. c-8 to c-18, c-111, and c-114).

In the heat treatment, when the expressions of $520 \leq Tmax \leq 800$, $0.1 \leq th \leq 90$, and $470 \leq Tmax - 90 \times th^{-1/2} \leq 620$ are satisfied; and the cooling rate during the cooling of the rolled material in a temperature range of 400° C. to 500° C. is higher than or equal to 1° C./sec, the area ratio of β phases dispersed in an α-phase matrix is likely to be in 0% to 0.9% (for example, refer to Test No. c-8 to c-18, c-107 to c-110, and c-112 to c-117). When the expressions of $540 \leq Tmax \leq 780$ and $0.15 \leq th \leq 50$ are satisfied; the cooling rate during the cooling of the rolled material in a temperature range of 400° C. to 500° C. is higher than or equal to 2° C./sec; and $(Tmax - 90 \times th^{-1/2})$ is greater than or equal to 480 or 495 and less than or equal to 600 or 580, the area ratio of β phases dispersed in an α-phase matrix is likely to be in 0% to 0.4%.

When the value of the composition index f1 of Cu, Ni, Mn ($f1 = [Cu] + 1.2 \times [Ni] + 0.4 \times [Mn]$) is less than 65.5, hot rolling could be performed; however, cracks having a size of 5 mm or greater were observed during cold rolling after hot rolling and there was a problem in cold workability. These samples have problems in consideration of mass production and the like. Therefore, the subsequent heat treatment and cold rolling and various evaluations were not performed. When the heat treatment and cold rolling were performed and various properties thereof were evaluated only for Test No. a-109, the amount of β phases was large. As a result, the cold workability was low, the tensile index $f2 = \sigma \times (1 + \epsilon/100)$ as the index indicating the balance between strength and ductility (in particular, ductility was low) was low, a large crack was formed during 180° bending, and the bactericidal and antibacterial properties, color fastness, corrosion resistance, and Ni allergy resistance were low.

In addition, when the value of the composition index f1 was greater than 70, a large crack was not formed during hot or cold rolling and the process could be performed until final cold rolling. However, since these samples had a low tensile strength, the tensile index f2 as the index indicating the balance between strength and elongation was less than or equal to 650. In addition, regarding the press property, a large burr was formed and there was a problem in workability (for example, refer to Test No. a-106, a-112, and a-120). When the value of f1 is less than or equal to 69.0 or is greater than or equal to 66.0, the value of f2 is high.

In the samples in which the amount of Cu was less than 51.0 mass % or greater than 58.0 mass %, the composition index f1 was out of the appropriate range in many cases and there were problems in various properties as described above (for example, refer to Test No. a-101 and a-106). In addition, in the above-described Test No. a-109, the composition index f1 was in the appropriate range but the amount of Cu was less than 51.0 mass %. Therefore, various properties were low as described above. The composition index f1 has a great relationship with the amount of Cu. In the samples in which the composition index f1 is out of the appropriate range, various properties are low. Accordingly, it is preferable that the amount of Cu be 51.0 mass % to 58.0 mass %. Furthermore, when the amount of Cu is 51.5 mass % to 57.0 mass %, various properties are further improved.

In Test No. a-111 in which the amount of Ni is greater than 12.5 mass %, the composition index f1 was in the appropriate range but the hot rolling property was low. Therefore, a large cracked edge was formed during hot rolling. In Test No. a-119 in which the amount of Ni is less than 9.0 mass %, the composition index f1 was in the appropriate range but the strength was low. Therefore, the value of the tensile index f2 indicting the balance between strength and elongation was low. In addition, the bactericidal property and color fastness were also low.

The amount of Ni also has a relationship with the composition index f1 but is required to be suppressed to 9.0 mass % to 12.5 mass %. When the amount of Ni is 10.0 mass % to 12.0 mass %, the properties are further improved.

In Test No. a-105, the amount of Ni was less than 9.0 mass %, but the amount of Pb was large at 0.032 mass %. Therefore, since a large cracked edge was formed during hot rolling and there was a problem in consideration of mass production, the subsequent processes such as cold rolling were stopped.

In the sample (Test No. a-117) in which the amount of Pb was greater than 0.030 mass %, similarly, a large cracked edge was formed during hot rolling. Therefore the subsequent investigations were stopped. On the other hand, when the amount of Pb was less than 0.0005 mass %, a large burr was formed in the punching test and there was a problem in workability (for example, refer to Test No. a-103). In this way, in the samples in which the amount of Pb was greater than 0.030 mass %, there was a problem in hot rolling property (hot workability); and in the samples in which the amount of pb was less than 0.0005 mass %, there was a problem in punching quality (burr). Accordingly, an appropriate range of 0.0005 mass % to 0.030 mass % is obtained.

In the sample (Test No. a-114) in which the amount of Mn was greater than 1.9 mass %, a large cracked edge was formed during hot rolling. The addition of Mn mainly increases the strength and has a high effect of improving the value of the tensile index f2 as compared to the samples not containing Mn. The effect was not exhibited when the amount of Mn was less than 0.05 mass %. In Test No. a-116 in which the amount of Mn was 0.03 mass %, substantially the same level of effect as that of the samples not containing Mn was exhibited and the tensile strength was slightly low. In this way, when the amount of Mn is 0.05% to 1.9 mass %, the strength was improved and the tensile index f2 was improved.

The bactericidal property was evaluated as B in many cases when the value of Zn/Cu was less than 0.58 or greater than or equal to 0.7. Therefore, not only the composition index f1 but also the ratio of Zn/Cu has an optimum range.

When the cooling rate in a temperature range of 400° C. to 500° C. after hot rolling was lower than 1° C./sec (0.2, 0.4, or 0.8° C./sec) or when the cooling rate in a temperature range of 400° C. to 500° C. during the heat treatment was lower than 1° C./sec (0.4, or 0.8° C./sec), the area ratio of β phases was increased, the cold rolling property, bactericidal and antibacterial properties, and color fastness deteriorated, the final heat treatment temperature was high, and the corrosion resistance deteriorated in a case where the grain size was large (for example, refer to Test No. c-111, c-112, c-114, c-119, and c-120). In Test No. c-111, c-114, c-119, c-121, c-123, c-104, c-129, and c-130, the cooling rate in a temperature range of 400° C. to 500° C. after hot rolling was lower than 1° C./sec and the area ratio of β phases was high. Therefore, the cold rolling property was evaluated as "C" and a large cracked edge was formed in the rolled material. In this way, even under production conditions having low practicality, crack portions in cracked edges were removed and the subsequent evaluations for various properties were performed.

In addition, when the amount of β phases is increased, the balance between strength and elongation deteriorates, the value of the tensile index $f2=\sigma\times(1+\epsilon/100)$ is lower than 650, and the bendability deteriorates. Therefore there is a problem for use in a component which requires high strength and a bending process.

When the cooling rate was higher than or equal to 1° C./sec and less than 2° C./sec, a small amount of β phases were precipitated, which affected the bactericidal and antibacterial properties and the color fastness. However, the balance (tensile index f2) between strength and elongation was higher than that in the case where the cooling rate was lower than 1° C./sec.

In this way, it is necessary that the cooling rate in a temperature range of 400° C. to 500° C. after hot rolling and the cooling rate in a temperature range of 400° C. to 500° C. during the heat treatment be higher than or equal to 1° C./sec. Furthermore, in a material in which the cooling rate is higher than 2° C./sec, no β phases appear, the workability, bactericidal and antibacterial properties, color fastness, and corrosion resistance are superior, and the balance between strength and elongation is also superior.

As described above, the area ratio of β phases affects the cold rolling property, balance between strength and elongation, bendability, bactericidal and antibacterial properties, color fastness, and corrosion resistance. When the area ratio of β phases is greater than or equal to 1.0%, the evaluation for any one of the above-described properties is low. In addition when the area ratio of β phases is less than 0.4%, there are not significant effects on the above-described properties and a material having superior various properties can be obtained. Therefore, the use of this material is not limited. The corrosion resistance is affected by not only the area ratio of β phases but also the grain size. In particular, in the samples in which the area ratio of β phases was greater than 1.0% and the grain size is greater than 15 μm (0.015 mm), dezincification corrosion having a size of greater than 200 μm was observed in the dezincification corrosion test according to ISO6509 (for example, refer to Test No. c-118 and c-120). Since β phases are present in a grain boundary and has a large grain size, the dezincification corrosion depth is great. When the area ratio of β phases is greater than 1.5%, even if the grain size is less than or equal to 10 μm (0.010 mm), there is a problem in dezincification corrosion (refer to Test No. c-129).

The maximum achieved temperature during the heat treatment has a relationship with the retention time in a temperature range from a temperature, which is 50° C. lower than the maximum achieved temperature, to the maximum achieved temperature. When the maximum achieved temperature is lower than or equal to 520° C., a recrystallization structure cannot be obtained and thus there is a problem in workability (for example, refer to Test No. c-108). When the maximum achieved temperature is higher than or equal to 800° C., the crystal grains are grown and the size thereof is greater than 30 μm (for example, refer to Test No. c-107). Therefore, rough portions (convex and concave portions on the surface) are formed on a surface subjected to strong plastic working such as bending or punching.

When the above-described retention time is shorter than or equal to 0.1 minutes, a sufficient recrystallization structure cannot be obtained and the balance between strength and elongation is low (for example, refer to Test No. c-116). In addition, when the heating time is long at 100 minutes, the crystal grains are grown and rough portions are formed on a surface subjected to strong plastic working (for example, refer to Test no. c-117).

When the heat treatment index It is less than 470, a recrystallization structure is not sufficiently obtained. In addition, when the heat treatment index It is greater than or equal to 620, crystal grains are coarse and rough portions are likely to be formed during 180° bending or the like and there is a problem in plastic working (workability), for example, a large burr is formed in the punching test (for example, refer to Test No. c-118 and c-124). When the heat treatment index It is greater than or equal to 480 or 495 and is less than or equal to 600 or 580, the optimum average grain size is obtained and the balance between strength and elongation is improved.

When the amount of Cu is less than or equal to 51 mass % (50.7 mass %; Zn:36.6 mass %), the area ratio of p phases is great. As a result, the balance between strength and elongation, bendability, corrosion resistance, color fastness, and bactericidal and antibacterial properties are low (refer to Test No. a-109).

When the amount of Ni is greater than 13 mass %, the cold workability is low and thus a cold-rolled material cannot be prepared (for example, refer to Test No. a-111). In addition, when the amount of Ni is less than 8.5 mass %, the balance between strength and elongation, bactericidal and antibacterial properties, and color fastness are low (for example, refer to Test No. a-119).

When the amounts of Pb and C are greater than 0.035 mass % and 0.012 mass %, respectively, there are problems in hot rolling property and cold rolling property. In particular, in the case of Pb, the hot rolling property is low and thus a product cannot be produced normally, for example, a large crack is formed (for example, refer to Test No. a-117 and a-115). Conversely, when the amounts of Pb and C are 0.0002 mass %, respectively, the punching quality is low, a large burr is formed during punching, and thus a burr removal operation is required, which causes an increase in production cost (for example, refer to Test No. a-118 and a-113).

In the materials containing 2.6 mass % of Mn, the hot rolling property and cold rolling property were low and the rolled material could not be produced (for example, refer to Test No. a-114). On the other hand, in the materials containing a low amount of Mn of 0.03 mass %, the punching quality was low and there is a problem (for example, refer to Test No. a-116).

In the material containing 0.32 mass % of Al, a firm oxide coating film of Al was formed on the surface and there were problems in bactericidal and antibacterial properties (refer to Test No. a-121).

In the material containing 0.12 mass % of P, a large cracked edge was formed at an end portion of the hot-rolled material and there was a problem in ductility during hot rolling (refer to Test No. a-122).

In the material containing 0.11 mass % of Sb and 0.13 mass % of As, a small cracked edge was observed during cold rolling and there was a problem in ductility during cold rolling, for example, cracks were formed in the bending test of bending the material by 180° C. (refer to Test No. a-123).

In addition, when the value of the composition index f1=[Cu]+1.2×[Ni]+0.4×[Mn] is less than or equal to 65, there are problems in hot and cold rolling properties. When value of the composition index f1 is greater than 70, the balance between strength and elongation is low. In particular, in a material in which the value of the composition index f1 is 66.0 to 69.0 and preferably 66.5 to 68.0, various properties are superior.

When the alloys according to the present invention are compared to C7521 (nickel silver) which is the material of the related art, the balance between strength and elongation and nickel allergy resistance are superior.

In addition, when the alloys according to the present invention are compared to C7060 which is a Cu/Ni alloy and C2680 which is brass (Cu/Zn alloy), the balance between strength and elongation is superior as in the case of C7521 and the punching quality (workability), bactericidal and antibacterial properties, color fastness, and corrosion resistance are superior. When the alloys according to the present invention are compared to C2680 subjected to the rust prevention treatment, the color fastness of developed alloys is superior and there is a significant difference in an exposure test of being in contact with human body for a long period of time.

In this way, it can be seen that the alloys according to the present invention exhibit the same quality of silver white as that of nickel silver and are the copper alloys having superior mechanical properties (high strength and balance between strength and elongation), hot workability, cold workability, color fastness, and bactericidal property (antibacterial property).

INDUSTRIAL APPLICABILITY

The silver-white copper alloy according to the present invention can be suitably applied to, in the hospital or public places, railings, door knobs, door handles, lever handles, push plates, poles, bed-side railings, writing materials, grips, dressing change carts, carriages, food carriers, carts, top-plate components of desks or working tables, keys, medical tool components, top plates of weighing machines, construction interior materials, railings of benches, chairs or the like, elevator interior materials, indoor electrical switches, buttons of remote controllers or the like, western tableware, musical instruments, mobile phones, covers of personal computers, and electrical components. In addition, the silver-white copper alloy according to the present invention can be suitably applied to silver-white materials produced without plating such as nickel plating.

The invention claimed is:

1. A method of producing a silver-white copper alloy, comprising the steps of:

(a) providing a silver-white copper alloy, comprising:

51.0 mass % to 57.0 mass % of Cu, 9.0 mass % to 12.5 mass % of Ni, 0.0003 mass % to 0.010 mass % of C, 0.0005 mass % to 0.030 mass % of Pb, and with a balance of Zn and inevitable impurities, and satisfying a relationship of $65.5 \leq [Cu]+1.2\times[Ni] \leq 69.0$ between an amount of Cu [Cu] (mass %) and an amount of Ni [Ni] (mass %), and satisfying a relationship of $0.58 \leq [Zn]/[Cu] < 0.7$ between an amount of Cu [Cu] (mass %) and an amount of Zn [Zn] (mass %);

(b) hot-rolling the silver-white copper alloy; and (c) cooling the hot-rolled silver-white copper alloy without quenching from a temperature immediately after the hot-rolling to a room temperature, wherein a cooling rate of the hot-rolled silver-white copper alloy in a temperature range of 400° C. to 500° C. is higher than or equal to 1° C./sec to provide a metal structure of the silver-white copper alloy having an area ratio of β phases dispersed in an α-phase matrix is 0% to 0.9%, wherein the silver-white copper alloy has superior bactericidal and color fastness properties.

2. The method of producing a silver-white copper alloy according to claim 1, wherein the silver-white copper alloy further comprises one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

3. A method of producing a silver-white copper alloy, comprising:

heating a rolled silver-white copper alloy to a predetermined temperature by using a continuous annealing line, thereby defining a heat treatment process, maintaining the rolled silver-white copper alloy at a predetermined temperature for a predetermined time, and cooling the rolled silver-white copper alloy to a predetermined temperature, wherein, when a maximum achieved temperature of the rolled silver-white copper alloy in the heat treatment process is represented by Tmax (° C.) and a retention time of the heat treatment process in a temperature range from a temperature, which is 50° C. lower than the maximum achieved temperature of the rolled silver-white copper alloy, to the maximum achieved temperature is represented by th (min), expressions of $520 \leq Tmax \leq 800$, $0.1 \leq th \leq 50$, and $470 \leq Tmax - 90\times th^{-1/2} \leq 620$ are satisfied and a cooling rate during the cooling of the rolled silver-white copper alloy in a temperature range of 400° C. to 500° C. is higher than or equal to 1° C./sec, wherein the silver-white copper alloy comprises:

51.0 mass % to 57.0 mass % of Cu, 9.0 mass % to 12.5 mass % of Ni, 0.0003 mass % to 0.010 mass % of C, 0.0005 mass % to 0.030 mass % of Pb, and with a balance of Zn and inevitable impurities, satisfying a relationship of $65.55 \leq [Cu]+1.2\times[Ni] \leq 69.0$ between an amount of Cu [Cu] (mass %) and an amount of Ni [Ni] (mass %), wherein a relationship of $0.58 \leq [Zn]/[Cu] < 0.7$ is satisfied between an amount of Cu [Cu] (mass %) and an amount of Zn [Zn] (mass %), wherein subsequent to cooling the silver-white copper alloy has a metal structure having an area ratio of (3 phases dispersed in an α-phase matrix is from 0% to 0.9%, and wherein the silver-white copper alloy has superior bactericidal and color fastness properties.

4. The method of producing a silver-white copper alloy according to claim 3, wherein the silver-white copper alloy further comprises one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

5. A method of producing a silver-white copper alloy, comprising:

cooling a hot-rolled silver-white copper alloy without quenching from a temperature immediately after the hot-rolling to a room temperature, wherein a cooling rate of the hot-rolled silver-white copper alloy in a temperature range of 400° C. to 500° C. is higher than or equal to 1° C./sec, wherein the silver-white copper alloy comprises:

51.0 mass % to 57.0 mass % of Cu, 9.0 mass % to 12.5 mass % of Ni, 0.05 mass % to 0.9 mass % of Mn, 0.0003 mass % to 0.010 mass % of C, 0.0005 mass % to 0.030 mass % of Pb, and a balance of Zn and inevitable impurities, satisfying a relationship of $65.5 \leq [Cu]+1.2\times[Ni]+0.4\times[Mn] \leq 69.0$ between an amount of Cu [Cu] (mass %), an amount of Ni [Ni] (mass %), and an amount of Mn [Mn] (mass %), wherein a relationship of $0.58 \leq [Zn]/[Cu] < 0.7$ is satisfied between an amount of Cu [Cu] (mass %) and an amount of Zn [Zn] (mass %), wherein in a metal structure thereof, an area ratio of β phases dispersed in an α-phase matrix is 0% to 0.9%, and wherein the silver-white copper alloy has superior bactericidal and color fastness properties.

6. The method of producing a silver-white copper alloy according to claim 5, wherein the silver-white copper alloy further comprises one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

7. A method of producing a silver-white copper alloy, comprising:

heating a rolled silver-white copper alloy to a predetermined temperature by using a continuous annealing line;

maintaining the rolled silver-white copper alloy at a predetermined temperature for a predetermined time; and cooling the rolled silver-white copper alloy to a predetermined temperature, wherein, when a maximum achieved temperature of the rolled silver-white copper alloy in the heat treatment process is represented by Tmax (° C.) and a retention time of the heat treatment process in a temperature range from a temperature, which is 50° C. lower than the maximum achieved temperature of the rolled silver-white copper alloy, to the maximum achieved temperature is represented by th (min), expressions of $520 \leq Tmax \leq 800$, $0.1 \leq th \leq 50$, and $470 \leq Tmax - 90\times th^{-1/2} \leq 620$ are satisfied and a cooling rate during the cooling of the rolled silver-white copper alloy in a temperature range of 400° C. to 500° C. is higher than or equal to 1° C./sec, wherein the silver-white copper alloy comprises:

51.0 mass % to 57.0 mass % of Cu, 9.0 mass % to 12.5 mass % of Ni, 0.05 mass % to 0.9 mass % of Mn, 0.0003 mass % to 0.010 mass % of C2

0.0005 mass % to 0.030 mass % of Pb, and the balance of Zn and inevitable impurities, satisfying a relationship of $65.5 \leq [Cu]+1.2\times[Ni]+0.4\times[Mn] \leq 9.0$ between an amount of Cu [Cu] (mass %), an amount of Ni [Ni] (mass %), and an amount of Mn [Mn] (mass %), wherein a relationship of $0.58 \leq [Zn]/[Cu] < 0.7$ is satisfied between an amount of Cu [Cu] (mass %) and an amount of Zn [Zn] (mass %), wherein in a metal structure thereof, an area ratio of β phases dispersed in an α-phase matrix is 0% to 0.9%, and wherein the silver-white copper alloy has superior bactericidal and color fastness properties.

8. The method of producing a silver-white copper alloy according to claim 7, wherein the silver-white copper alloy further comprises one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

9. A method of producing a silver-white copper alloy, comprising cooling a hot-rolled silver-white copper alloy without quenching from a temperature immediately after the hot-rolling to a room temperature, wherein a cooling rate of a hot-rolled silver-white copper alloy in a temperature range of 400° C. to 500° C. is higher than or equal to 1° C./sec, wherein the silver-white copper alloy comprises:

51.5 mass % to 57.0 mass % of Cu, 10.0 mass % to 12.0 mass % of Ni, 0.05 mass % to 0.9 mass % of Mn, 0.0005 mass % to 0.008 mass % of C, 0.001 mass % to 0.009 mass % of Pb, and with a balance of Zn and inevitable impurities, satisfying a relationship of $66.0 \leq [Cu]+1.2\times[Ni]+0.4\times[Mn] \leq 68.0$ between an amount of Cu [Cu] (mass %), an amount of Ni [Ni] (mass %), and an amount of Mn [Mn] (mass %), wherein a relationship of $0.58 \leq [Zn]/[Cu] < 0.7$ is satisfied between an amount of Cu [Cu] (mass %) and an amount of Zn [Zn] (mass %), wherein in a metal structure thereof, an area ratio of β phases dispersed in an α-phase matrix is 0% to 0.4%, and wherein the silver-white copper alloy has superior bactericidal and color fastness properties.

10. The method of producing a silver-white copper alloy according to claim 9, wherein the silver-white copper alloy further comprises one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

11. A method of producing a silver-white copper alloy, comprising:

heating a rolled silver-white copper alloy to a predetermined temperature by using a continuous annealing line;

maintaining the rolled silver-white copper alloy at a predetermined temperature for a predetermined time; and cooling the rolled silver-white copper alloy to a predetermined temperature, wherein, when a maximum achieved temperature of the rolled silver-white copper alloy in the heat treatment process is represented by Tmax (° C.) and a retention time of the heat treatment process in a temperature range from a temperature, which is 50° C. lower than the maximum achieved temperature of the rolled silver-white copper alloy, to the maximum achieved temperature is represented by th (min), expressions of $520 \leq Tmax \leq 800$, $0.1 \leq th \leq 50$, and $470 \leq Tmax - 90 \times th^{-1/2} \leq 620$ are satisfied and a cooling rate during the cooling of the rolled silver-white copper alloy in a temperature range of 400° C. to 500° C. is higher than or equal to 1° C./sec, wherein the silver-white copper alloy comprises:

51.5 mass % to 57.0 mass % of Cu, 10.0 mass % to 12.0 mass % of Ni, 0.05 mass % to 0.9 mass % of Mn, 0.0005 mass % to 0.008 mass % of C, 0.001 mass % to 0.009 mass % of Pb, and with a balance of Zn and inevitable impurities, satisfying a relationship of $66.0 \leq [Cu]+1.2 \times [Ni]+0.4 \times [Mn] \leq 68.0$ between an amount of Cu [Cu] (mass %), an amount of Ni [Ni] (mass %), and an amount of Mn [Mn] (mass %), wherein a relationship of $0.58 \leq [Zn]/[Cu] < 0.7$ is satisfied between an amount of Cu [Cu] (mass %) and an amount of Zn [Zn] (mass %), wherein in a metal structure thereof, an area ratio of β phases dispersed in an α-phase matrix is 0% to 0.4%, and wherein the silver-white copper alloy has superior bactericidal and color fastness properties.

12. The method of producing a silver-white copper alloy according to claim 11, wherein the silver-white copper alloy further comprises one or more selected from a group consisting of 0.01 mass % to 0.3 mass % of Al, 0.005 mass % to 0.09 mass % of P, 0.01 mass % to 0.09 mass % of Sb, 0.01 mass % to 0.09 mass % of As, and 0.001 mass % to 0.03 mass % of Mg.

13. A method of producing a silver-white copper alloy, comprising:

heating a rolled silver-white copper alloy to a predetermined temperature by using a continuous annealing line, thereby defining a heat treatment process, maintaining the rolled silver-white copper alloy at a predetermined temperature for a predetermined time, and cooling the rolled silver-white copper alloy to a predetermined temperature, wherein, when a maximum achieved temperature of the rolled silver-white copper alloy in the heat treatment process is represented by Tmax (° C.) and a retention time of the heat treatment process in a temperature range from a temperature, which is 50° C. lower than the maximum achieved temperature of the rolled silver-white copper alloy, to the maximum achieved temperature is represented by th (min), expressions of $680 \leq Tmax \leq 730$, $0.25 \leq th \leq 0.5$, and $470 \leq Tmax - 90 \times th^{-1/2} \leq 620$ are satisfied and a cooling rate during the cooling of the rolled silver-white copper alloy in a temperature range of 400° C. to 500° C. is higher than or equal to 1° C./sec, without quenching from a temperature immediately after the heat treatment process to a room temperature, wherein the silver-white copper alloy comprises:

51.0 mass % to 57.0 mass % of Cu, 9.0 mass % to 12.5 mass % of Ni, 0.0003 mass % to 0.010 mass % of C, 0.0005 mass % to 0.030 mass % of Pb, and with a balance of Zn and inevitable impurities, satisfying a relationship of $65.5 \leq [Cu]+1.2 \times [Ni] \leq 69.0$ between an amount of Cu [Cu] (mass %) and an amount of Ni [Ni] (mass %), wherein a relationship of $0.58 \leq [Zn]/[Cu] < 0.7$ is satisfied between an amount of Cu [Cu] (mass %) and an amount of Zn [Zn] (mass %);

wherein subsequent to cooling the silver-white copper alloy has a metal structure having an area ratio of β phases dispersed in an α-phase matrix is from 0% to 0.9%, and wherein the silver-white copper alloy has superior bactericidal and color fastness properties.

* * * * *